US012790088B2

(12) United States Patent
Nelson

(10) Patent No.: US 12,790,088 B2
(45) Date of Patent: Nov. 10, 2026

(54) DYNAMICALLY MIXING BEVERAGE VESSEL

(71) Applicant: Garrett Thomas Nelson, Shoreview, MN (US)

(72) Inventor: Garrett Thomas Nelson, Shoreview, MN (US)

(73) Assignee: Garrett Thomas Nelson, Reno, NV (US)

( * ) Notice: Subject to any disclaimer, the term of this patent is extended or adjusted under 35 U.S.C. 154(b) by 0 days.

(21) Appl. No.: 18/820,176

(22) Filed: Aug. 29, 2024

(65) Prior Publication Data

US 2025/0074671 A1 Mar. 6, 2025

Related U.S. Application Data

(60) Provisional application No. 63/535,560, filed on Aug. 30, 2023.

(51) Int. Cl.

| | |
|---|---|
| ***B65D 81/32*** | (2006.01) |
| ***A47G 19/22*** | (2006.01) |
| ***B65D 51/02*** | (2006.01) |
| ***B65D 51/28*** | (2006.01) |

(52) U.S. Cl.
CPC ..... *B65D 51/2885* (2013.01); *A47G 19/2205* (2013.01); *B65D 51/02* (2013.01); *B65D 81/3222* (2013.01)

(58) Field of Classification Search
CPC ..... A47J 31/407; A47J 43/27; A47J 19/2205; B65D 81/3222; B65D 51/2885; B65D 51/28; B65D 81/3211; B65D 81/32; B65D 81/3216; B65D 85/72; B65D 51/2835; B65D 43/16; B65D 51/18
USPC ..... 215/DIG. 8, 6; 206/222, 219, 221, 522; 222/129
See application file for complete search history.

(56) References Cited

U.S. PATENT DOCUMENTS

| | | | | |
|---|---|---|---|---|
| 5,261,569 | A | 11/1993 | Sandwell | |
| 5,330,081 | A | 7/1994 | Davenport | |
| 8,733,578 | B2 | 5/2014 | Michaels | |
| 9,119,490 | B1 | 9/2015 | Parodi, Jr. | |
| 9,637,272 | B2 * | 5/2017 | Albaum | B65D 43/16 |
| 10,433,632 | B2 * | 10/2019 | Resic | B01F 35/522 |
| 10,464,710 | B2 | 11/2019 | Dehghani | |

(Continued)

*Primary Examiner* — King M Chu
(74) *Attorney, Agent, or Firm* — SCHWEGMAN LUNDBERG & WOESSNER, P.A.

(57) ABSTRACT

A portable beverage vessel allows for dynamic mixing of two isolated liquids. An outer container holds a first liquid while an inner container holding a second liquid fits inside the outer container. A lid seals the outer container and suspends the inner container. A force distribution member rests between the lid and inner container. Applying force to the lid transfers through the force distribution member to release the inner container into the outer container, mixing the liquids. The transparent outer container provides a visual of the falling inner container. The lid and inner container engage in a snap-fit suspension. A removable lid cover allows drinking access. The vessel is sized for portability and handheld drinking. The force distribution member enables controlled release of the inner container. The liquids remain isolated until mixing is desired. The vessel efficiently and intuitively mixes two liquids for enjoyment from one container.

7 Claims, 22 Drawing Sheets

(56) References Cited

U.S. PATENT DOCUMENTS

| | | | | |
|---|---|---|---|---|
| 2002/0153344 | A1 | 10/2002 | Pola et al. | |
| 2003/0002385 | A1 | 1/2003 | Pola et al. | |
| 2008/0011710 | A1 | 1/2008 | Cohn | |
| 2011/0266247 | A1 | 11/2011 | Littrell | |
| 2014/0147559 | A1 | 5/2014 | Aidan | |
| 2015/0250343 | A1 | 9/2015 | De Klein | |
| 2016/0052686 | A1* | 2/2016 | Macy ..... | A47G 19/2205 220/212 |
| 2017/0320640 | A1 | 11/2017 | Steinmann | |
| 2020/0377281 | A1 | 12/2020 | Picciallo | |

* cited by examiner

DYNAMICALLY MIXING BEVERAGE VESSEL

CLAIM OF PRIORITY

This application claims the benefit of priority under 35 U.S.C. § 119(e) to U.S. Provisional Patent Application Ser. No. 63/535,560, filed on Aug. 30, 2023, which is incorporated by reference herein in its entirety.

BACKGROUND

In restaurants, bars, and other venues where alcoholic and non-alcoholic drinks are being prepared, there exists a practice of providing a small quantity of alcoholic beverage or other liquid, such as a shot of a more potent alcohol (whiskey vodka, rum, etc etc.) in conjunction with a larger quantity of a weaker alcoholic beverage or other liquid (beer, juice, tea, etc.). In some circumstances, individuals desire to mix the two before their consumption.

Typically, the larger quantity of liquid beverage is prepared in a larger container (beer mug, pint glass, etc.) and the smaller quantity of liquid beverage is prepared in a shot glass, which may not necessarily be made of glass. This requires an individual's attention, such as that of a bartender, to prepare two separate containers and distribute the appropriate quantities of two separate liquids into each container. This process is time-consuming. Thereafter, a consumer, such as a patron at the bar may drop the shot glass containing the first smaller beverage into the second larger beverage container, which can produce a satisfying "plop," "clink," or other splash effects at the bottom of the larger beverage container. In addition, the consumer can, in some circumstances, observe the liquids mixing to a satisfactory effect for the user. After the liquids are mixed, the consumer typically consumes the mixed beverage. It can be appreciated that when dropping a shot of liquor into an energy drink, beer, or other beverage and consuming it immediately, the consumer may experience a different taste than just mixing the components and letting the beverages sit.

Because these beverages are prepared and served in two separate individual containers, these cocktails can only be sold within restaurants, bars, or other mixologist-types of establishments. Alternatively, eager beverage enthusiasts can also prepare the beverages themselves. When preparing the 2-part beverages themselves, the consumer may need to purchase all of the individual ingredients, prepare each container with the proper amount of liquid, and clean all of the containers after consumption. This involves a great deal of time and effort, causing many beverage enthusiasts to avoid the procedure. Given the current state of the beverage industry, there is no viable portable beverage container capable of storing the two liquids independently until the dynamic mixing of the said liquids is desired in the satisfying fashion described earlier.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

INTRODUCTION

Figure 1:
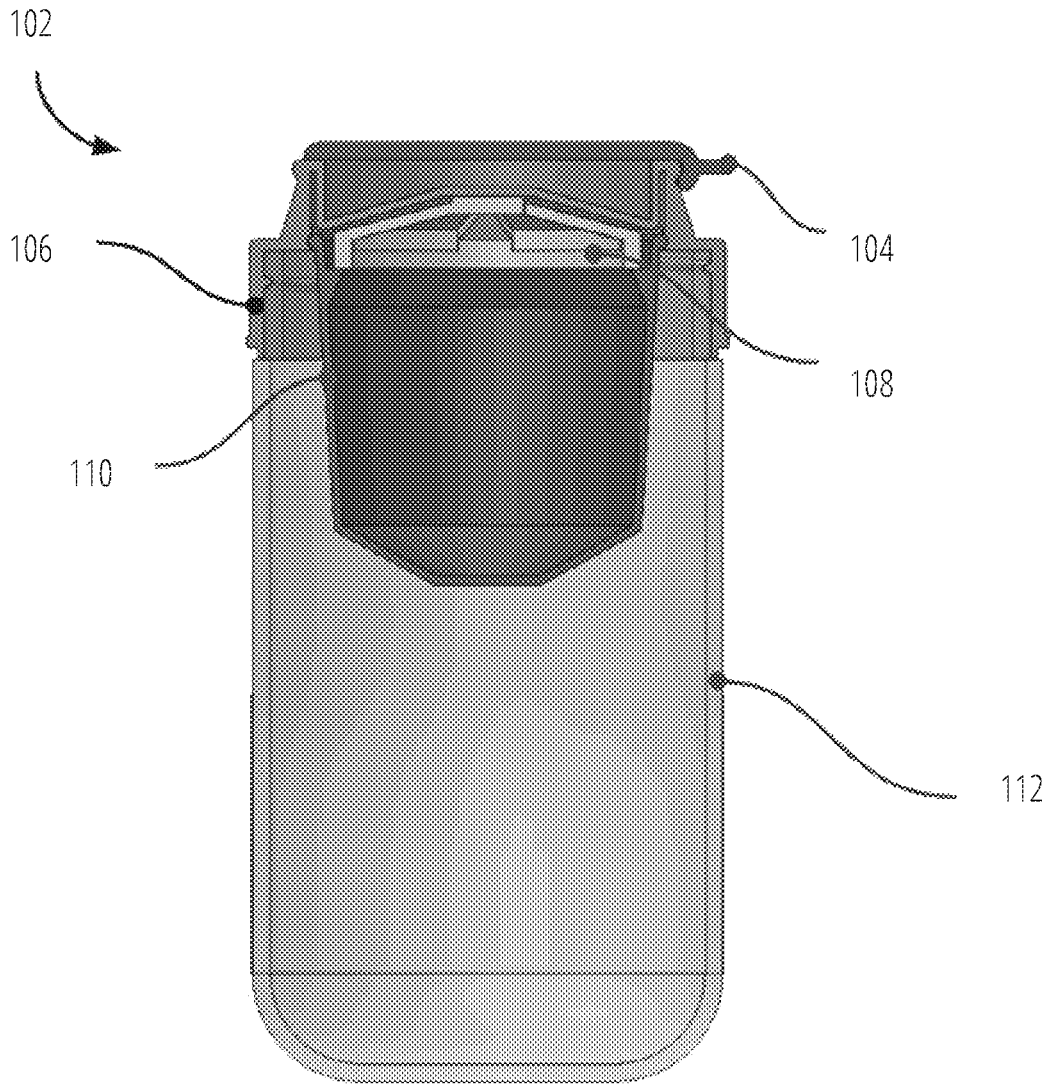
FIG. 1 is a diagram of a cross-sectional front view of a dynamically mixing beverage vessel fully assembled, according to some examples.

The current market needs may be addressed by the present examples described herein. The examples simplify the two-vessel "drop shot" experience into a single ready-to-drink beverage vessel. Some examples provide a new beverage vessel with a built-in, pre-filled shot glass that is sealed from the larger mixing container below. The assembled shot glass can then be "released" or "deployed" into the larger mixing container below creating a fresh, dynamically mixed cocktail at the consumer's discretion. The design of the beverage vessel is user-friendly and intuitive to use as it requires minimal user manipulation to release and enjoy the freshly mixed cocktail. It also provides a satisfying splash effect mimicking the traditional "drop shot experience" where the consumer sees, hears, and/or feels the shot physically dropping into the larger beverage container below.

This pre-packaged beverage vessel seeks to eliminate the need to prepare two separate individual beverage vessels for a traditional "drop shot" liquid refreshment. This new ready-to-drink vessel simplifies the process required to serve and distribute a traditional "drop shot" beverage. Not only can these beverages be prepared and distributed faster than the traditional two-vessel experience, but they are also easily cleaned up after their consumption. This pre-packaged vessel is easily delivered to consumers via waiters and/or waitresses at bars, restaurants, or beverage environments.

For the beverage enthusiast at home, this vessel addresses the need to purchase and transport a full bottle of liquor and prepare beverages for multiple consumers. The ready-to-drink aspect of the single vessel appeals to the general consumer as it is simple to use, efficient to distribute, and convenient to clean or dispose of compared to the traditional self-prepared two-part "drop shot" beverage.

The examples can also be used as a container for liquor distributors to market ready-to-drink "drop shot" or "bombing" cocktails. With this new all-in-one efficient vessel, the traditional two-container cocktail can now be served and distributed through all beverage channels, including but not limited to: liquor stores, gas stations, grocery stores, and general stores. These vessels are capable of being sold within a prepackaged cardboard container similar to that of beer, seltzer, and other assorted beverages sold in multiples.

These examples may be understood by reference to the drawing figures submitted herewith. Those skilled in the art will understand that various features of the drawings discussed below are not necessarily drawn to scale and that dimensions of various features and elements of the drawings may be expanded or reduced to more clearly illustrate examples described herein. Furthermore, the drawings are for the purpose of illustration only and are not intended as a definition of the limits.

Some examples related to a system and method for a drop shot beverage container with an efficient, user-friendly design, which does not require extensive user manipulation, and which provides the satisfying clink or splash sound of the traditional drop shot method whereby the consumer sees, hears, and/or feels the shot dropping into the beverage with a satisfying effect.

Some examples related to a system and method for a drop shot beverage container that can be easily transported around by a waiter and/or waitress in a commercial environment such as restaurants, bars, or other mixologist-types of establishments.

Some examples related to a ready-to-drink container for a 2-part dynamically mixed beverage that can be sealed and sold in liquor stores.

DETAILED DESCRIPTION

Mixed alcoholic beverages that combine a shot of liquor with a larger quantity of a mixer (such as an energy drink) may use two separate containers-one for the shot of liquor and one for the mixer. This requires a bartender or server to prepare and distribute two separate drinks, which can be time-consuming and inefficient. It also requires the customer to drop the shot of liquor into the mixer themselves to combine the drinks, which can lead to splashing, mess, and an unsatisfying experience.

Some customers enjoy the experience of dropping the shot into the mixer and observing the effect, but outside of bars and restaurants, customers have not had a simple and convenient way to recreate this experience themselves. Providing pre-made mixed drinks in a single container that customers deploy at the time of their choosing allows more customers to enjoy the "drop shot" experience in a simple, mess-free fashion.

However, containing two separate liquids in one vessel and allowing one liquid to be deployed into the other at a desired time presents several technical challenges, including, for example:

1. The vessel may need to keep the liquids completely separate until deployment to avoid premature mixing.
2. The vessel may need to allow for easy and controlled deployment of the inner shot by the customer.
3. The vessel may need to provide a satisfying visual experience of the deployment, including allowing the customer to see the shot fall into the mixer.
4. The vessel must be able to withstand the forces of the inner shot falling into the mixer without breaking or leaking.
5. The vessel must allow for easy consumption of the mixed drink after deployment.

The examples described aim to address these and other technical challenges with an innovative vessel design and method for dynamically mixing two liquids. By addressing these and other challenges, the invention provides customers with a new way to enjoy mixed drinks in a simple, mess-free fashion.

The detailed description below is intended as a description of various configurations of the subject technology. It is not intended to represent the only configurations in which the subject technology may be practiced. The appended drawings are incorporated herein and constitute a part of the detailed description. The subject technology is not limited to the specific details set forth herein and may be practiced without these specific details.

Furthermore, the proportions to which all of these components mate with one another are not accurately depicted in these examples; rather, these depictures are meant to serve as an aid to understanding the novel and unique concept under consideration.

FIG. 1 depicts a cross-sectional front view of a dynamically mixing beverage vessel 102 fully assembled, according to some examples, containing a cap 104 (e.g., a transportation cap), a lid 106 (e.g., a threaded splash lid), a force distribution member 108 (e.g., a downforce distribution tool), an inner shot container 110 (e.g., an inner ridge container), and an outer mixing container 112 (e.g., a mixing vessel). The dynamically mixing beverage vessel in this assembly depiction includes but is not limited to these five individual components listed.

In the assembled configuration, the cap 104 is secured to the top of the lid 106 via snap-fit armatures. The lid 106 is secured to the outer mixing container 112 via threads on the interior outer wall of the lid 106. These threads match and mate with the threads depicted on the exterior surface of the outer mixing container 112 neck. Furthermore, the inner shot container 110 is affixed to the lid 106 via a snap-fit seal around the rim of the inner ridge shot container, this creates a suspension position of the inner container. In other examples, the inner shot container 110 may be configured with other components, such as the outer mixing container 112 or the force distribution member 108, to create a similar suspension position. The force distribution member 108 is not physically fixed to any of the other components, rather, the force distribution member fits snugly on top of the inner shot container 110 and below the lid 106. The contour of the force distribution member 108 is similar to that of the inner contours on the lid 106. This makes for a compact, fully assembled beverage vessel 102 configuration.

This illustration also depicts the scale to which the inner shot container 110 fits within the larger outer mixing container 112. The inner shot container 110 is also secured and sealed to the lid 106 isolating the substance (liquid and/or material) from the rest of the assembly.

Figure 2:
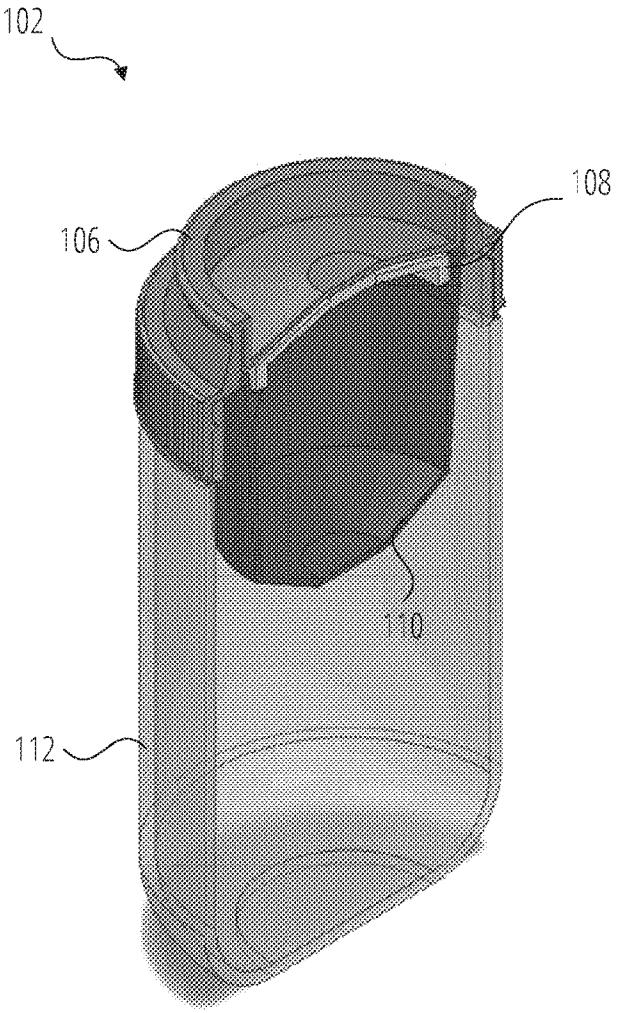
FIG. 2 is a diagram of a perspective cross-sectional view of a portable dynamically mixing beverage vessel in accordance with some examples.

FIG. 2 depicts a perspective cross-sectional view of a portable beverage vessel 102 in accordance with some examples, which helps convey the cylindrical shape of all the components within the assembly. As seen in the perspective illustration, the outer mixing container 112 reflects a standard cylindrical beverage vessel. All of the components are also cylindrical so that they match concentrically in the finally fully assembled beverage vessel 102 configuration.

Figure 3:
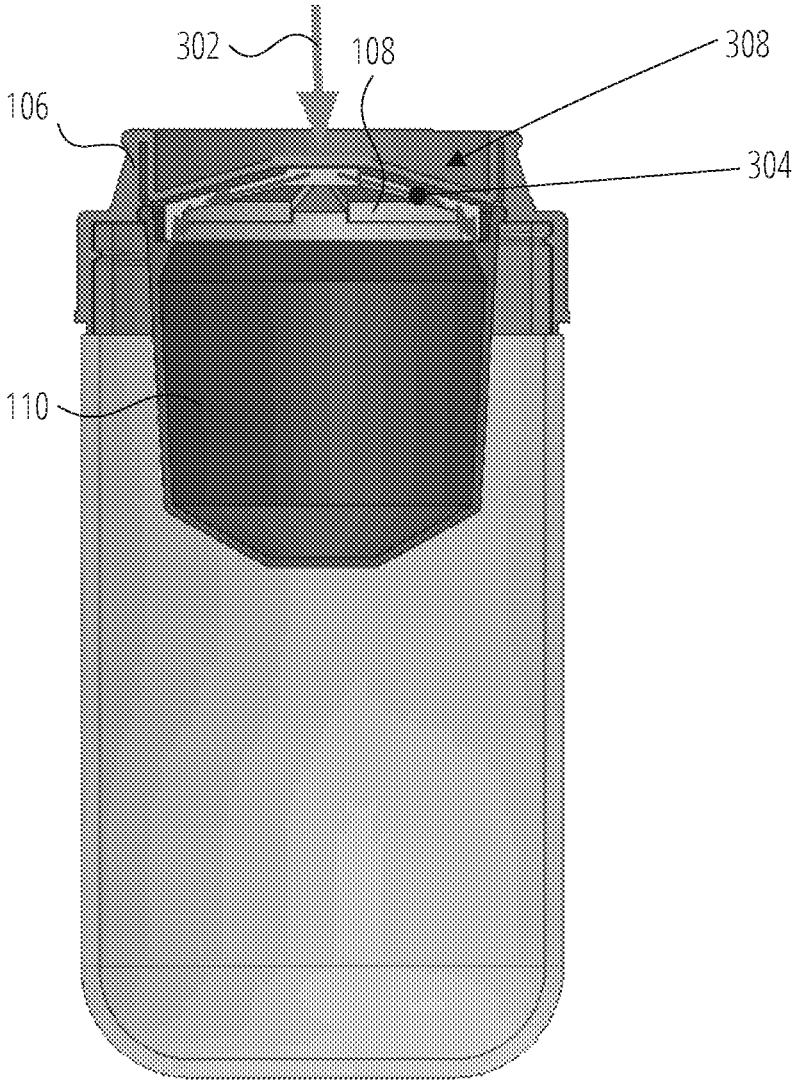
FIG. 3 is a diagram of a cross-sectional view of a portable dynamically mixing beverage vessel, in accordance with some examples, showing the "transportation cap" removed from the splash lid.
Figure 3:
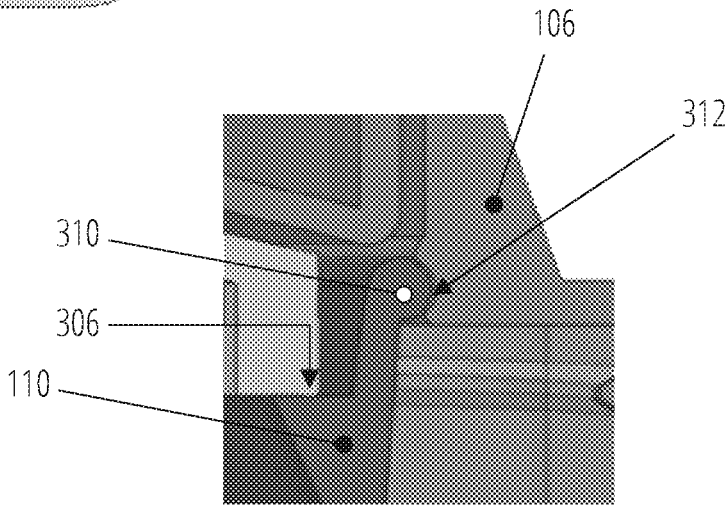

FIG. 3 depicts a cross-sectional view of the beverage vessel 102 with the cap 104 removed. The cap 104 prevents unintentionally deploying the apparatus during transportation between final assembly and reaching the consumer. The cap 104 may be removed from the top of the lid 106 before the inner shot container 110 can be deployed. This is the first step required in recreating the "drop shot" experience in a portable configuration.

This illustration also displays the act in which the inner shot container 110 is deployed into the outer mixing container 112. The downward force 302 depicts where the user or consumer of the product would apply a downforce to the deformable top surface 308 of the lid 106 in order to "release" or "deploy" the inner shot container 110. The downward force 302 would then be distributed through the force distribution member 108 illustrated by the distributed force 304. This distributed force 304 is then directly transferred to the inner shot container 110's inner ridge surface 306. The downforce applied on the inner shot container 110 ultimately compromises the snap-fit seal with the lid 106. Once this snap-fit seal is compromised, the downward force 302 from the consumer applied to the inner shot container 110 propels the inner shot container 110 downward into the outer mixing container 112. In some examples, the snap-fit seal is formed by the outer rim 310 of the inner shot container 110 and ridge groove 312 of the lid 106.

Figure 4:
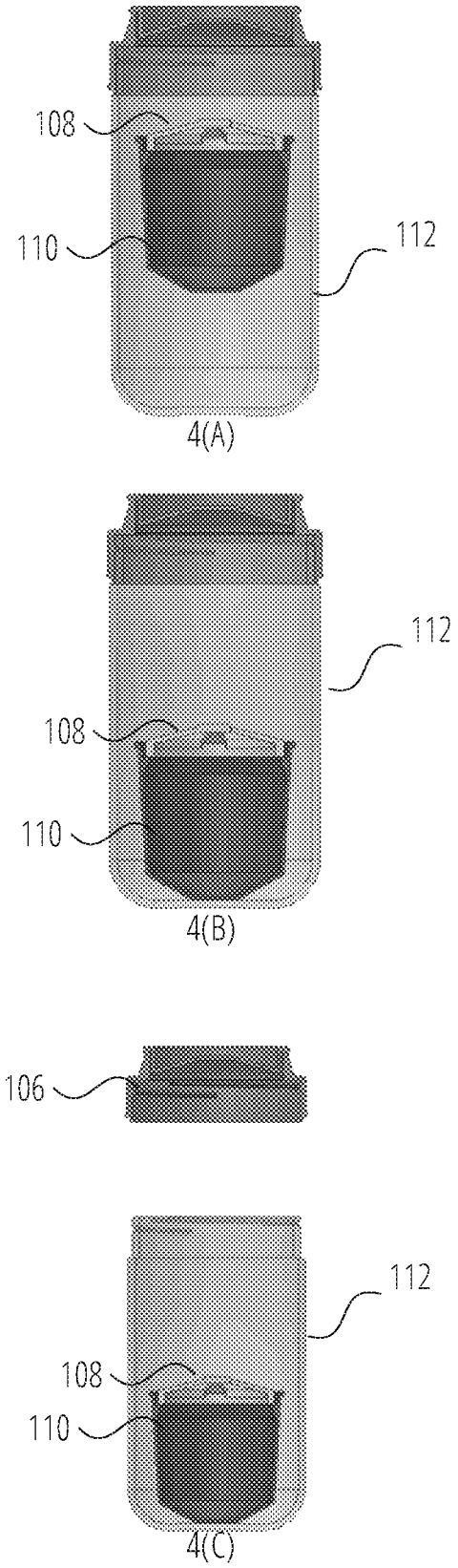
FIG. 4 is a diagram of a cross-sectional view of a portable dynamically mixing beverage vessel shortly after the inner container has been "released" or "deployed" into the outer container.

FIG. 4 depicts a cross-sectional view of the inner container in motion shortly after being "released" or "deployed" into the outer container. The inner shot container 110 in this depiction is falling into the outer mixing container 112 below. Thereafter, the inner shot container 110 contacts the larger quantity of liquid beverage stored in the outer mixing container 112. When the inner shot container 110 contacts the liquid below, this provides a satisfying splash effect mimicking the traditional "drop shot" experience where the consumer sees, hears, and/or feels the shot physically dropping into the outer mixing container 112. The consumer is hereby visually and/or acoustically stimulated by this process due to the transparent nature of the outer mixing container 112.

FIG. 4 (*c*) displays a cross-sectional view of the beverage vessel 102 with the inner shot container 110 resting on the bottom of the outer mixing container 112 and the lid 106 fully removed from the outer mixing container 112. Removing the lid 106 from the outer mixing container 112 is performed before consuming the dynamically mixed beverage. The lid 106 is removed from the outer mixing container 112 by twisting the lid. Once the lid 106 is removed from the outer mixing container 112, the outer mixing container 112 is then tilted towards the user. As both liquids within the inner shot container 110 and outer mixing container 112 start to flow out of their respective containers, they mix proportionally before hitting the user's mouth. This helps ensure the user is experiencing the proper dynamically mixed beverage flavor.

Figure 5:
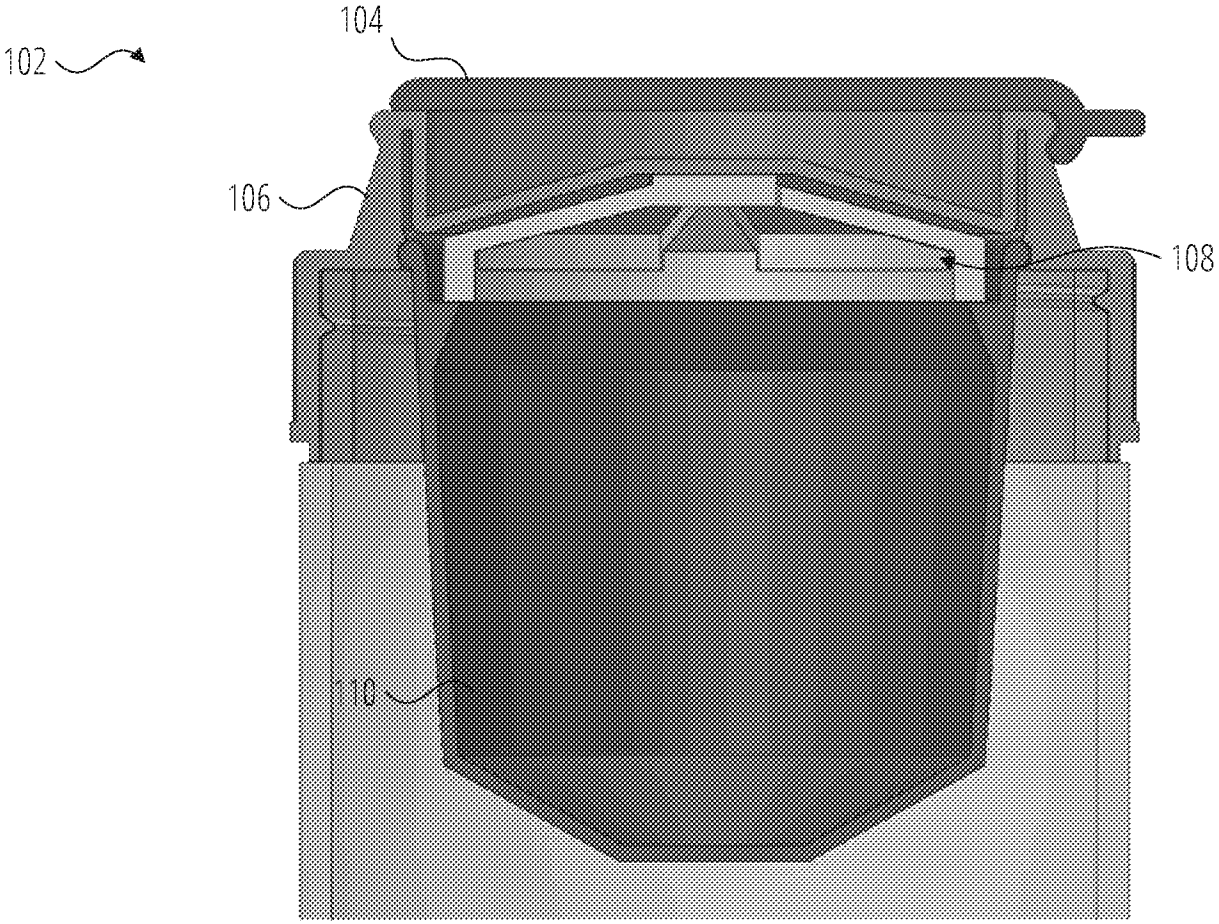
FIG. 5 is a diagram of a cross-sectional view of a portable 2-part dynamically mixing beverage vessel in accordance with some examples.

FIG. 5 depicts a cross-sectional close-up view of the beverage vessel 102. This illustration depicts the compact contours of the lid 106, the force distribution member 108, the inner shot container 110, and the cap 104.

The contour of the force distribution members 108 closely matches the inner geometry of the lid 106. This allows the two components to fit snugly in the space between the lid 106 and inner shot container 110 when fully assembled, creating a compact configuration when fully assembled.

Figure 6:
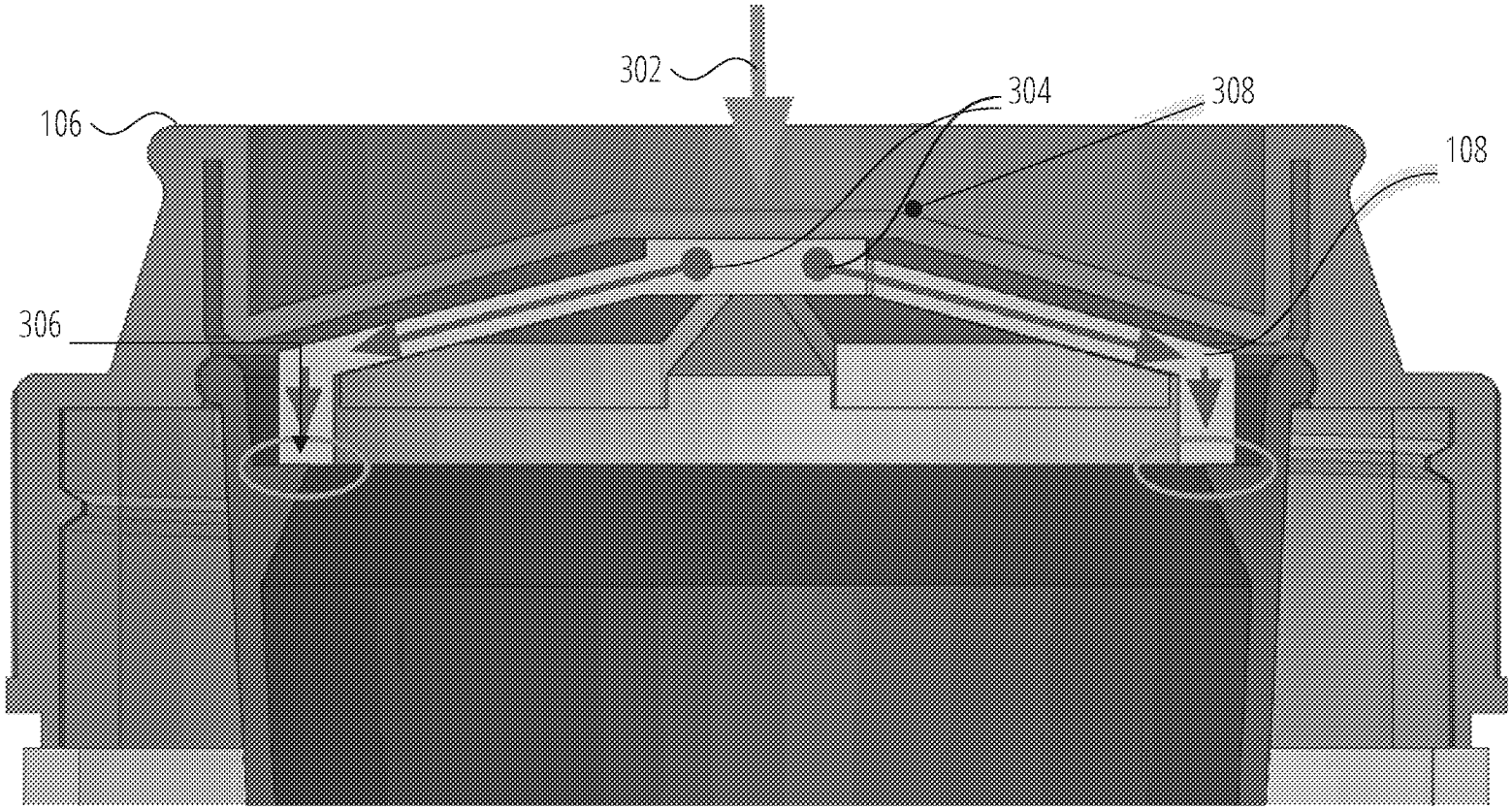
FIG. 6 is a diagram of a cross-sectional view of the lid, force distribution member, and the inner container during the deployment process.

FIG. 6 depicts a diagram of a cross-sectional view of the lid, the force distribution member, and the inner container during the deployment process. In order to "release" or "deploy" the inner shot container 110 from a suspended position into the outer mixing container 112 below, the user can easily manipulate the lid 106 by applying a downward force 302 to the center of the deformable top surface 308 of the lid 106. The downward force 302 from the consumer is transferred through the force distribution member 108 illustrated by the blue arrows in FIG. 6 304. This force is ultimately exerted on the inner ridge surface 306 highlighted in the oval of the inner shot container 110. When the consumer applies downward force 302 to the center of the deformable top surface 308, this ultimately exerts enough downward force on the inner shot container 110 in so that the snap-fit seal formed by the outer rim 310 and ridge groove 312 is compromised, thus deploying the inner ridge inner shot container 110 downward into the mixing outer mixing container 112.

Figure 7:
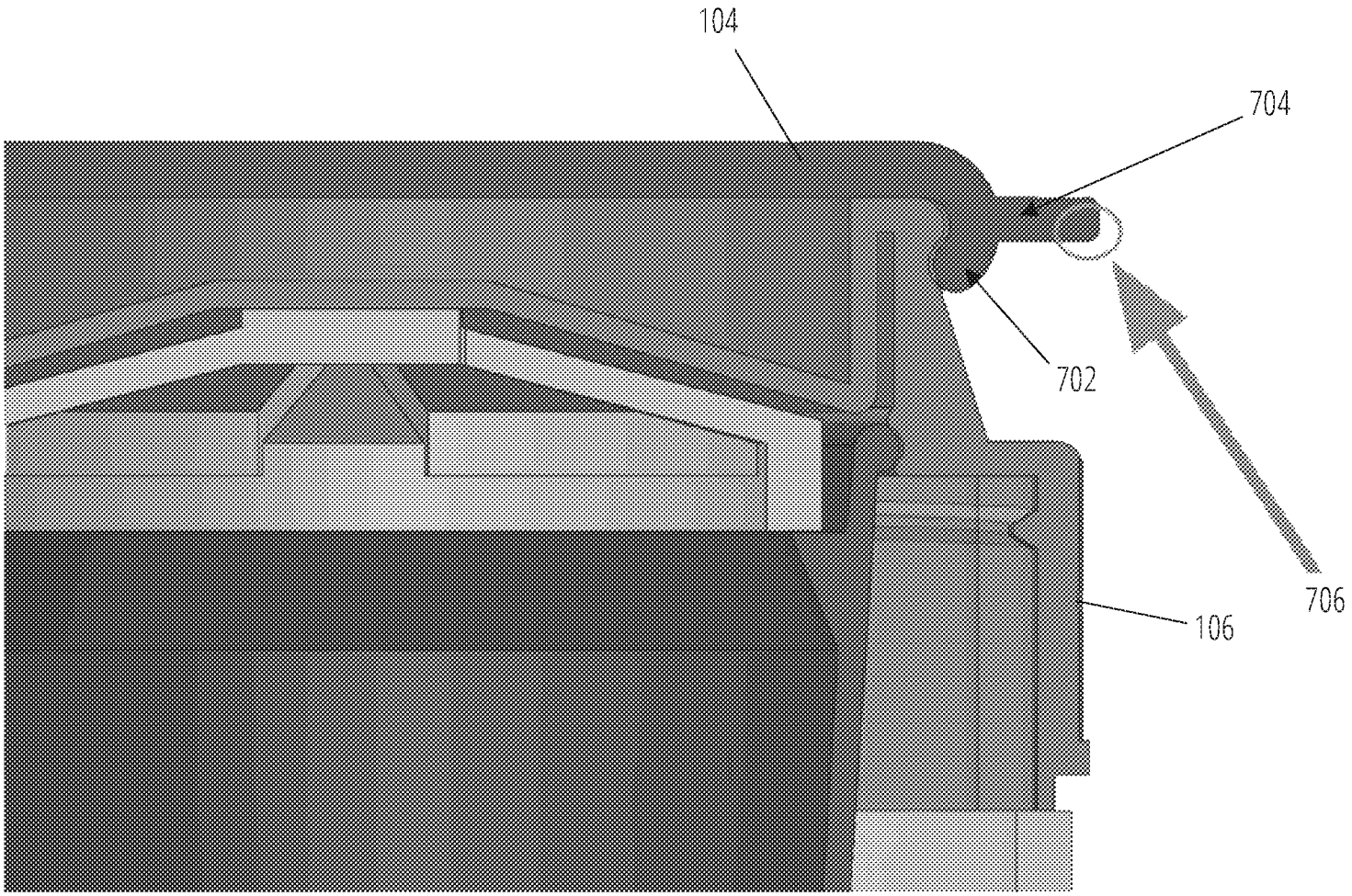
FIG. 7 is a diagram of a cross-sectional view of a mixing beverage vessel highlighting the removal process of the cap from the lid, in accordance with some examples.

FIG. 7 depicts a diagram of a cross-sectional view of the dynamically mixing beverage vessel 102 highlighting the removal process of the cap 104 from the lid 106. The cap 104 is secured to the lid 106 by a snap fit. The curved armatures 702 on the cap 104 snap onto the upper rim of the lid 106. One of the curved armatures 702 contains a cantilevered tab 704, which is used in the removal process from the lid 106. To remove the cap 104, the user applies an upward force 706 to the cantilevered tab 704 as shown by the arrow in FIG. 7. When this upward force 706 is applied to the cantilevered tab 704, the curved armatures 702 securing the cap to the lid 106 are elastically deformed compromising the snap-fixturing. This allows for the efficient easy removal of the cap 104 from the lid 106.

Figure 8:
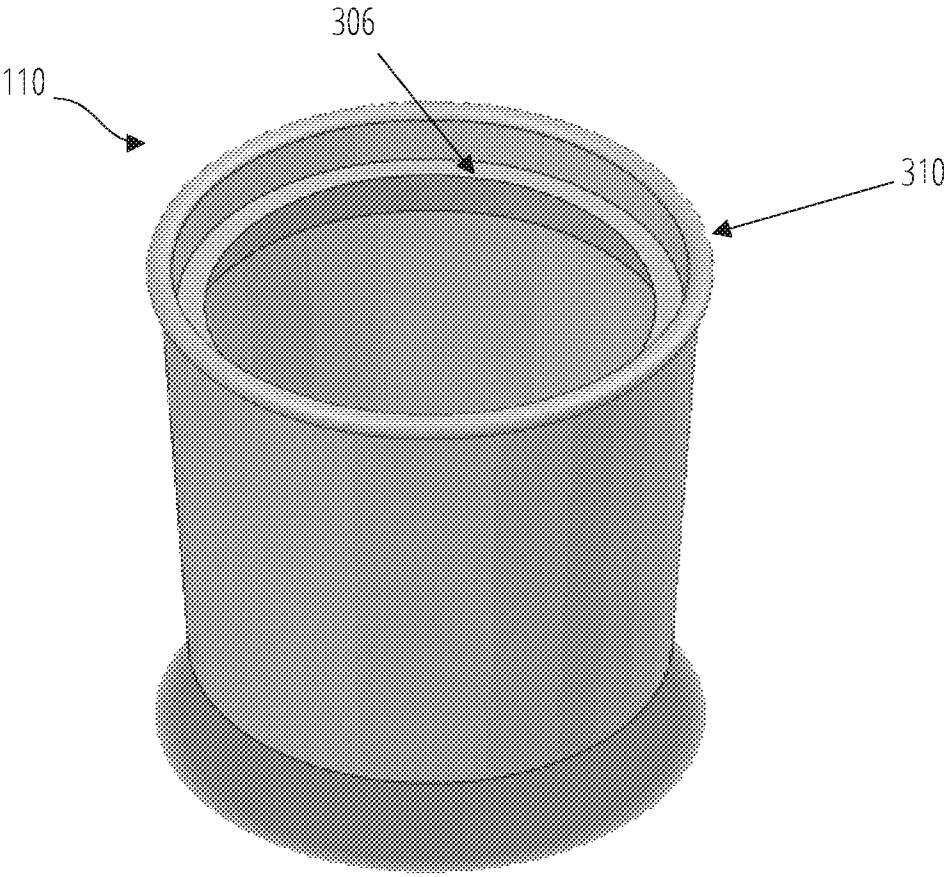
FIG. 8 is a diagram of a perspective view of an inner container in accordance with some examples.

FIG. 8 is a diagram of a perspective view of the inner shot container 110, in accordance with some examples. This component is made from a rigid material and is not limited to this material. In some examples, the inner shot container 110 can be made from aluminum or plastic material. The overall size of the inner shot container 110 is designed to hold the equivalent of one "shot" or "serving" of liquid beverage. The physical measurement of one "shot" or "serving" may change depending on the concentration of the liquid beverage stored in the inner shot container 110. For this matter, the physical size of inner shot container 110 may change depending on the configuration and application of the assembly.

Furthermore, the outer rim 310 of the inner shot container 110 is "rolled" in that it will mate with the ridge groove 312 of the lid 106, creating a snap-fit liquid-proof seal. This isolates the contents stored within the inner shot container 110 from the contents in the outer mixing container 112 below. This rolled outer rim 310 design is depicted in the perspective view of FIG. 8.

The inner shot container 110 also has an inner ridge surface 306 within the inner shot container 110, unlike traditional shot vessels. This inner ridge surface 306 is located towards the top of the inner shot container 110 and provides a surface that mates with the force distribution member 108. The force distribution member 108 sits concentrically on top of this inner ridge surface 306 and transfers the consumer's downward force 302 to the inner ridge surface 306.

Figure 9:
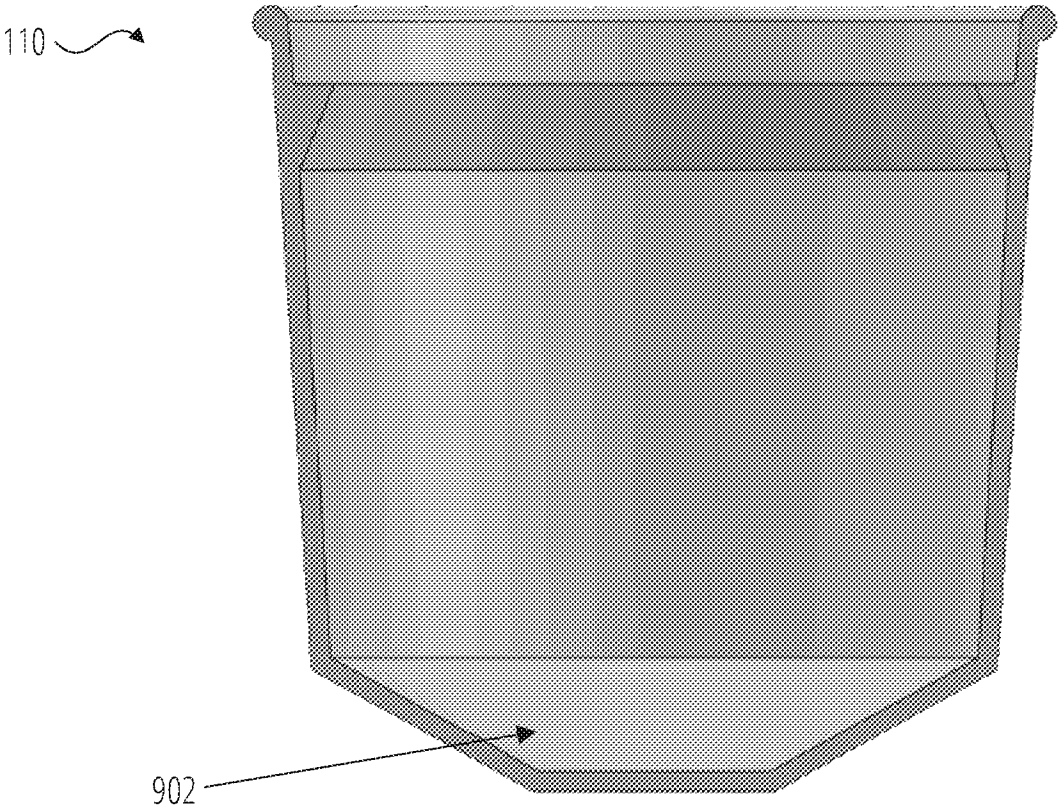
FIG. 9 is a diagram of a cross-sectional view of the inner container, which is designed specifically for the dynamically mixing beverage vessel in accordance with some examples.

FIG. 9 depicts a cross-sectional view of the inner shot container 110, which is designed specifically for the dynamically mixing beverage vessel 102, in accordance with some examples. The inner shot container 110 has a conical base 902 to help induce a larger "splash" effect when the deployed shot inner shot container 110 collides with the liquid within the outer mixing container 112. The larger splashing effect not only promotes a satisfying and stimulating "drop shot" experience for the consumer, but also promotes the dynamic mixing of the two previously isolated liquid contents. When the inner shot container 110 is deployed into the outer mixing container 112, the outer container fluid is displaced upwards and away from the bottom of the inner shot container 110. The outer container fluid is displaced towards the walls of the outer mixing container 112. The mixing vessel fluid then "ricochets" or "rebounds" off the walls of the outer mixing container 112 into the surrounding air above. Part of the mixing vessel fluid lands on top of the shot inner shot container 110, helping mix the 2-part beverage prior to consumption.

Furthermore, once the user is ready to consume the beverage, the user will tip up the outer mixing container 112 so that both the liquid within the inner shot container 110 and the outer mixing container 112 fluid flow out at the same time. By tilting the outer mixing container 112 in a drinking fashion, the two pre-isolated liquids mix properly before reaching the consumer's mouth. This helps ensure that the user experiences a different taste than just mixing the components and letting the beverages sit.

Figure 10:
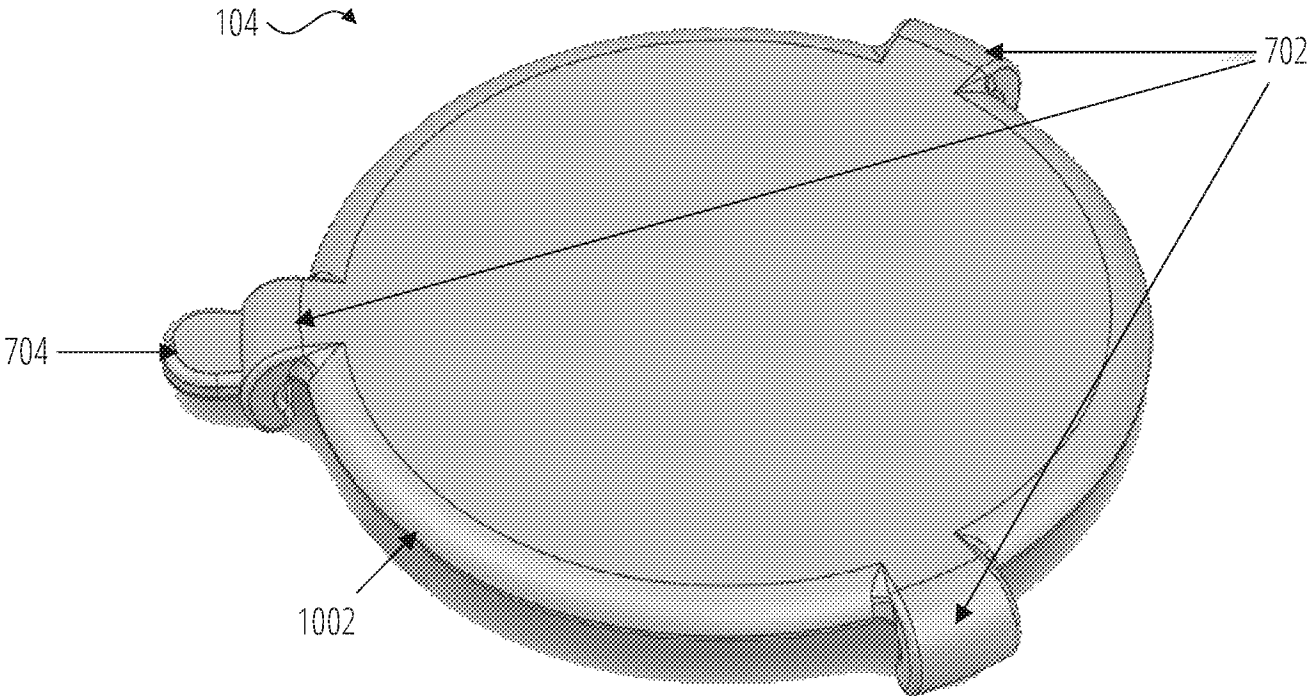
FIG. 10 is a diagram of a perspective view of the cap's design, contours, and functional features in accordance with some examples.

FIG. 10 depicts a perspective view of a design, contours, and functional features of the transportation cap 104 in accordance with some examples. The cap 104 has three curved armatures 702 that help secure the cap 104 to the lid 106. One of these curved armatures 702 has a cantilevered tab 704, which is utilized in the removal of the cap 104 from the lid 106. The described examples provide a similar aesthetic to that of the other cylindrical or circular components of the beverage vessel 102. It shall also be noted that the edges 1002 of the cap 104 have been filleted or rounded on the outer upper edge of the cap in order to prevent any harm to the user (sharp edge prevention).

The cap 104 is made from a rigid plastic material. The rigidness of the cap 104 helps prevent any unexpected debris, or outside environmental anomalies from pre-maturely deploying the inner shot container 110. When a downforce is applied to the transportation cap 104, the downforce is transferred to the edge of the cap where it contacts the deformable top surface 308 of the lid 106. This downward force applied to the top of the lid 106 is transferred through the lid 106 to the outside walls of the outer mixing container 112 via the threaded configuration between these two components. Because of this, the cap 104 protects the inner shot container 110 from pre-mature deployment. For example, if the user attempted to deploy the inner shot container 110 with the cap 104 secured to the lid 106, the rigid material from the cap 104 would transfer the applied force through the outside of the lid 106 and onto the walls of the outer mixing container 112.

Figure 11:
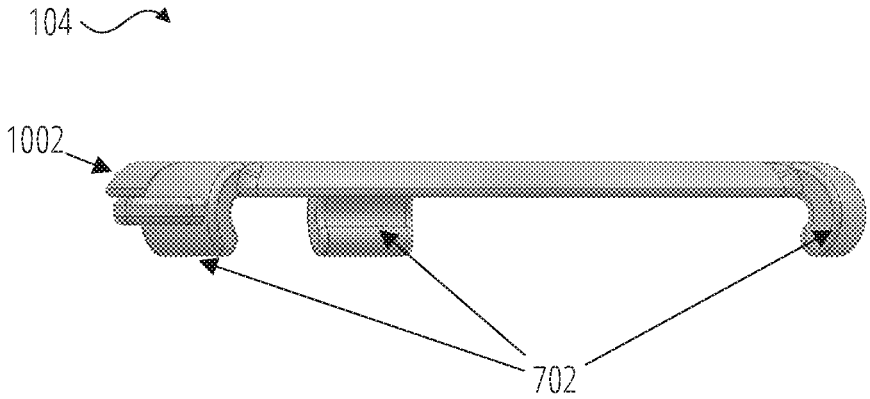
FIG. 11 is a diagram of a side profile view of a cap, in accordance with some examples.
Figure 11:
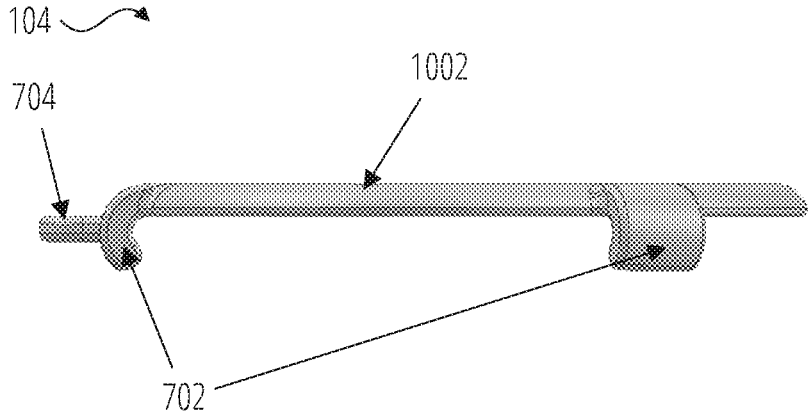

FIG. 11 is a diagram of a side profile view of a cap 104 in accordance with some examples. It depicts two images of a side profile view of the transportation cap 104 to better illustrate the curved armatures 702 that help secure the cap 104 to the lid 106. These depictions also show the filleted and rounded edges 1002 on the cap 104 that create a user-friendly design. In the second depiction of the transportation cap 104, the cantilevered tab 704 feature is highlighted on the far-left curved armatures 702.

Figure 12:
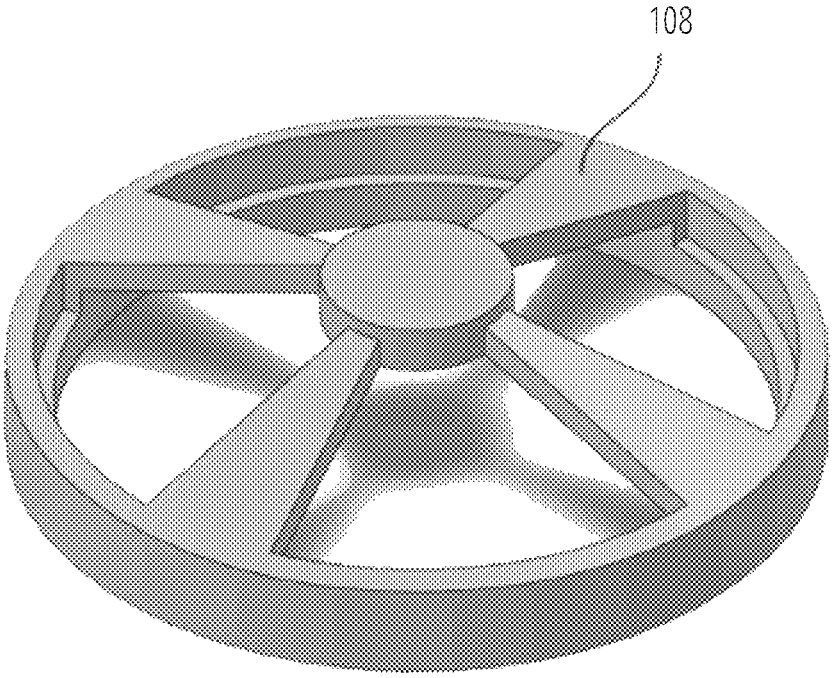
FIG. 12 is a diagram of a perspective view of the force distribution member, in accordance with some examples.

FIG. 12 depicts a perspective view of the force distribution member 108, according to some examples. This force distribution member 108 transfers the user's applied downward force 302 on the lid 106 to the inner ridge surface 306 on the inner shot container 110. The force distribution member 108 is made from a rigid plastic material. The rigid material promotes the most efficient transfer of downforce from the lid 106 to the inner shot container 110.

Figure 13:
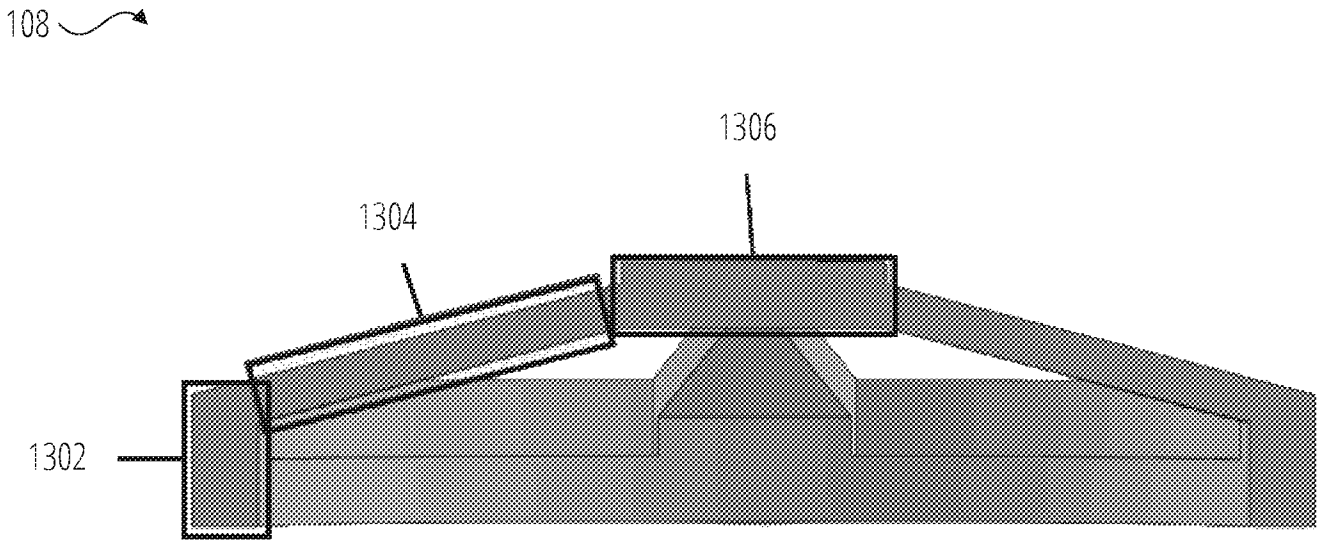
FIG. 13 is a diagram of a cross-sectional view of an example force distribution member, which may be used in some examples.

FIG. 13 depicts a cross-sectional view of a force distribution member, according to some examples. The force distribution member 108 has three parts including an outer ring 1302, interior supports 1304, and a contact slab 1306. The bottom surface of the outer ring 1302 operatively rests on top of the inner ridge surface 306 of the inner shot container 110.

The outer ring 1302 diameter is smaller than the inner diameter of the inner shot container 110. This ensures that the force distribution member 108 rests gently on top of the inner ridge surface 306 of the inner shot container 110. By resting on top of the inner shot container 110, the force distribution member 108 is concentrically aligned to both the inner shot container 110 and the lid 106.

The interior supports 1304 are connected to the outer ring 1302 as well as the contact slab 1306. The interior supports 1304 are connected to the outer ring 1302 and the contact slab 1306. These interior supports 1304 help distribute the downward force 302 applied to the contact slab 1306 evenly to the outer ring 1302 of the force distribution member 108. In the illustrated example of the force distribution member 108, there are four independent interior supports 1304. The force distribution member 108 may have more or less interior supports 1304 depending on the configuration's final application.

The contact slab 1306 is the third feature of the force distribution member 108 that makes contact with the lid 106. This feature is a circular slab that collects the total downward force 302 applied by the user and distributes the force to the interior supports 1304 accordingly. This feature matches the contours and shape of the lid 106.

Figure 14:
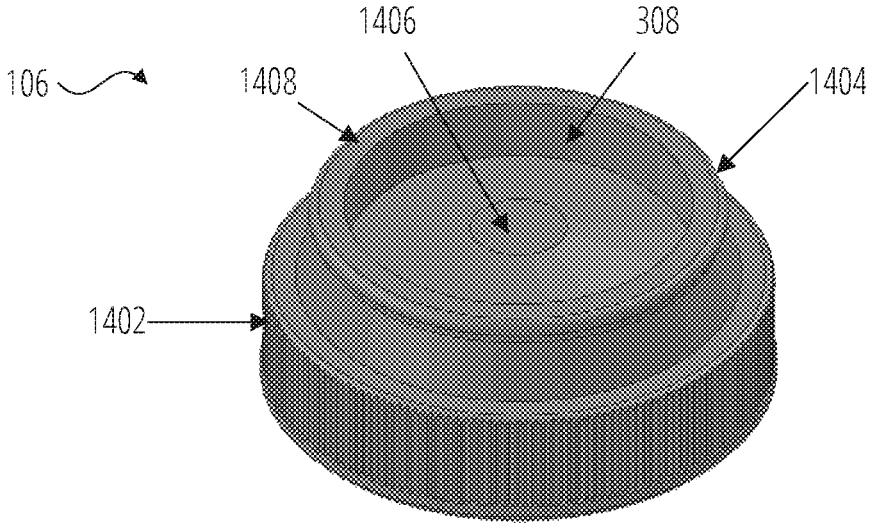
FIG. 14 is a diagram of a perspective view of an example lid in accordance with some examples.

FIG. 14 depicts a perspective view of a threaded splash lid 106, in accordance with some examples. From this perspective, multiple features are present on the lid 106, including, but not limited to, a knurled outer edge 1402, a rim 1404, and a dimple 1406.

The knurled outer edge 1402 of the lid 106 helps consumers grip and break the pressurized seal between the lid 106 and outer mixing container 112.

The rim 1404 is the rounded edge at the top surface of the lid 106. There is a flat contact surface 1408 on the top of the lid 106 where the cap 104 contacts the lid 106. The curved armatures 702 from the cap 104 extend around the rim 1404, creating the snap-fit fixturing of the cap 104 to the lid 106.

The dimple 1406 is the circular angled feature in the center of the deformable top surface 308 of the lid 106. The dimple 1406 is where the consumer or user applies a downward force 302 "releasing" or "deploying" the inner shot container 110 into the outer mixing container 112. The shape of this feature on the lid 106 easily communicates to the user that action is required in order to deploy the inner shot container 110.

The lid 106 is made from a liquid-tight, non-porous plastic material. This allows the thin-walled sections (e.g., deformable top surface 308) of the lid to be elastic and flexible, yet still watertight. Furthermore, this allows the thick-walled sections to remain rigid.

Figure 15:
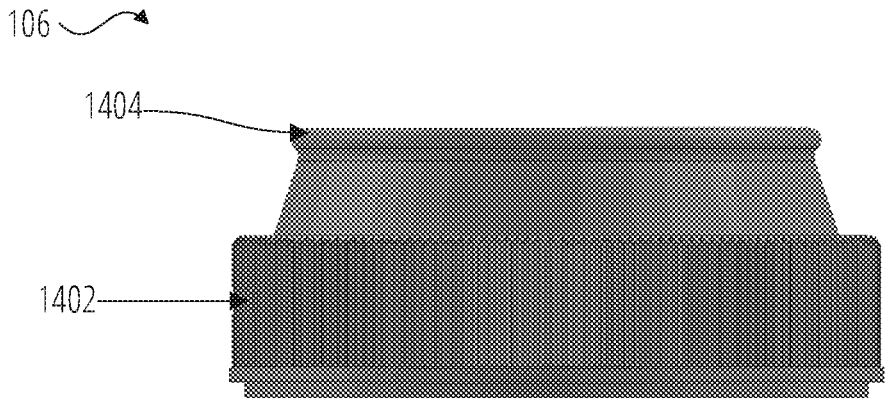
FIG. 15 is a diagram of a side profile view of the threaded splash lid, in accordance with some examples.

FIG. 15 depicts a side profile view of the threaded splash lid 106, according to some examples. It depicts the knurled outer edge 1402 and the rim 1404 features more clearly. The rim 1404 is the curved edge on the top surface of the lid 106. The knurled outer edge 1402 on the outside surface of the lid 106 allows the consumer to easily and efficiently remove the lid 106. The knurled outer edge 1402 creates a higher coefficient of friction between the consumer's hand and the lid 106. This ensures the easy removal of the lid 106 in different temperature environments where the dynamically mixing beverage vessel may "sweat" or condensate.

Figure 16:
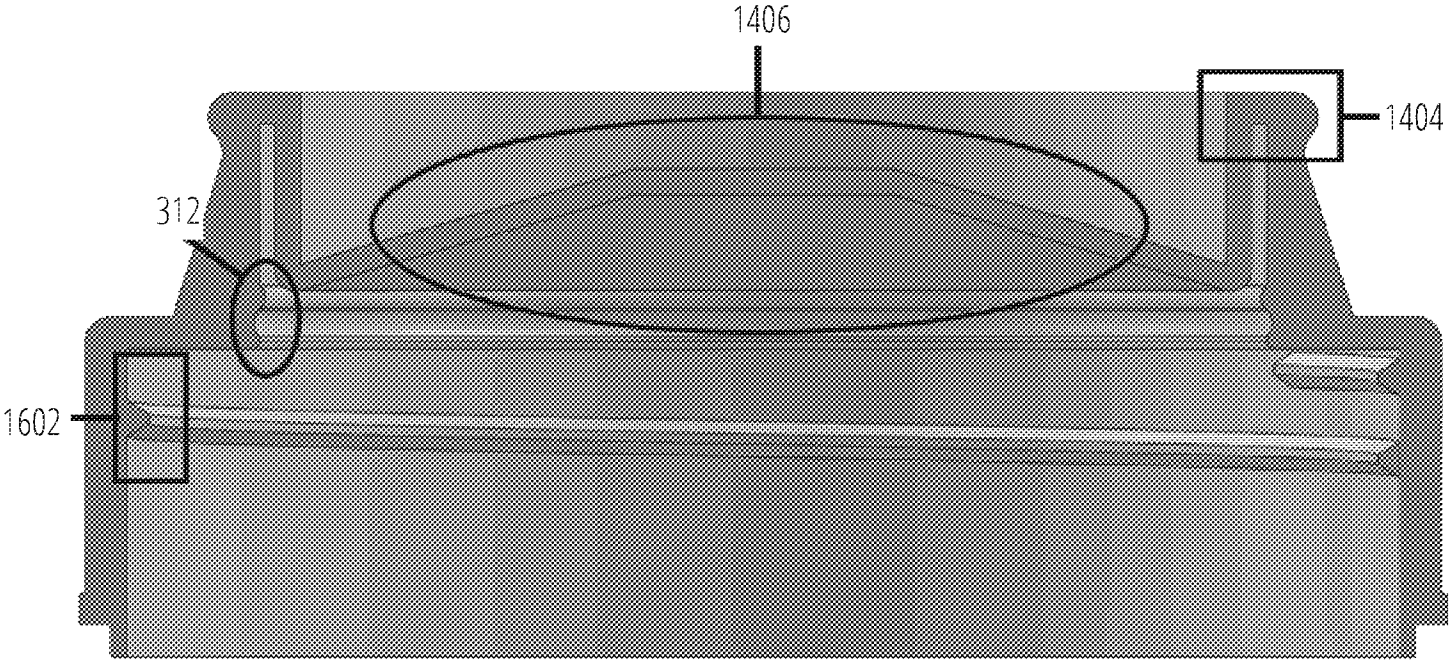
FIG. 16 is a diagram of a cross-sectional view of the lid, in accordance with some examples.

FIG. 16 depicts a cross-sectional view of the threaded splash lid 106 where multiple features of the lid are illustrated, including but not limited to: interior threads 1602, the ridge groove 312, the dimple 1406, and the rim 1404.

The interior threads 1602 on the lid 106 are primarily used to secure the lid 106 to the outer mixing container 112 and are highlighted in the rectangle. This example depicts a right-handed thread with a single start. In other configurations of the lid 106, there may be multiple starts and/or left-handed threads. The threads could also be extruded or cut. The lid 106 and the outer mixing container 112 create a liquid-proof seal ensuring that none of the mixing vessel fluid can escape. This seal isolates the components and substances within the complete assembly from the outside environment ensuring a "food-safe" product.

The ridge groove 312 is highlighted in FIG. 16. This ridge groove 312 creates another liquid-proof seal between the lid 106 and the inner shot container 110. This creates another "food safe" seal isolating the contents within the inner shot containers 110 from the contents within the outer mixing containers 112. The ridge groove 312 matches the geometry and curvature of the outer rim 310 on the inner shot container 110. The arc'd curvature of the ridge groove 312 extends both above and below the apex of the arc (the point at which the groove has the largest diameter) preventing the inner shot container 110 from moving in the vertical Y-axis.

The dimple 1406 is highlighted in FIG. 16. This dimple 1406 is thin-walled so that it exhibits elastic material properties during deployment of the inner shot container 110. This dimple extends downward force 302 from the deformable top surface 308 of the lid 106 and inward towards the center of the lid. The flat part of the dimple 1406 remains below the top plane of the lid 106. This ensures that any downward force applied to the cap 104 is not transferred onto the force distribution member 108, which could prematurely release or deploy the inner shot container 110.

Because of this geometry and due to the elastic material properties of the thin-walled section of the lid 106, the dimple 1406 acts as a reverse spring during deployment of the inner shot container 110. Once enough force is applied to the center of the dimple 1406, the thin-walled section collapses on itself and restructures itself inverted to the current depiction of the dimple. This helps propel the inner shot container 110 into the outer mixing container 112 in a fashion that mimics the traditional "drop shot experience" where the consumer sees, hears, and/or feels the shot physically dropping into the larger beverage container below.

The rim 1404 is also depicted again in FIG. 16 by the rectangle. The curved armatures 702 on the cap 104 and the rim 1404 mate in so that they create a snap-fit.

Figure 17:
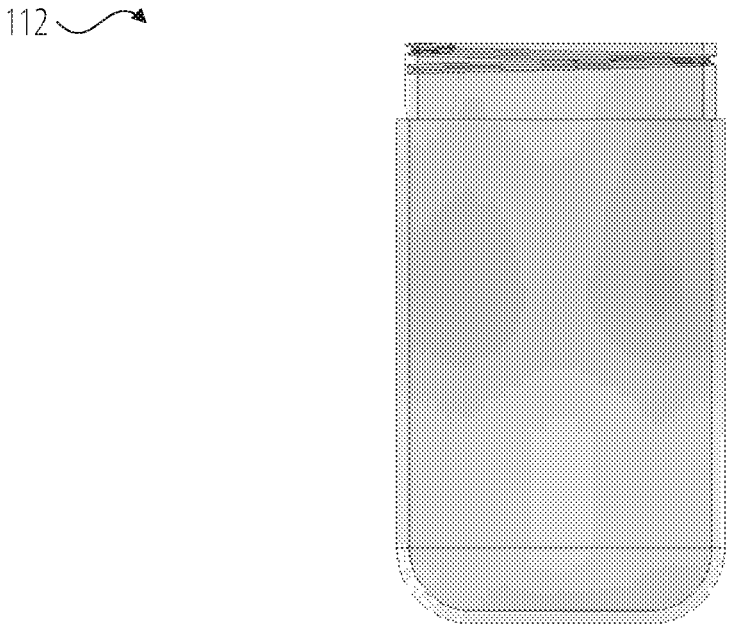
FIG. 17 is a diagram of a cross-sectional view of the outer container.

FIG. 17 depicts a cross-sectional view of an example of the outer mixing container 112. The outer mixing container 112 is a liquid-tight, non-porous clear beverage vessel, and can be made from glass and/or plastic but is not limited to just these materials. The outer mixing container 112 is transparent in nature in order to provide a satisfying splash effect where the consumer sees, hears, and/or feels the shot physically dropping into the larger beverage container below. With the clear mixing vessel, the consumer is visually stimulated by the deployment process of the inner shot containers 110.

Figure 18:
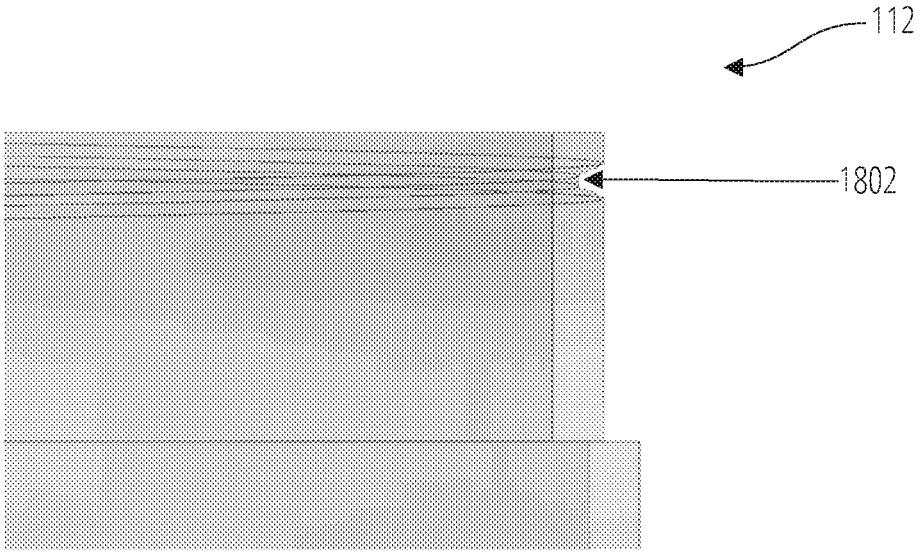
FIG. 18 is a diagram of a cross-sectional view of the outer container's thread path.

FIG. 18 depicts a cross-sectional view of one example of the thread path of the outer mixing container 112. The threads 1802 in this example are cut into the outer mixing container 112, but in other configurations, these threads are extruded from the neck of the outer mixing container 112. The threads on the neck of the outer mixing container 112 help secure the threaded splash lid 106 to the outer mixing container 112, creating a liquid-tight seal between the two surfaces.

Figure 19:
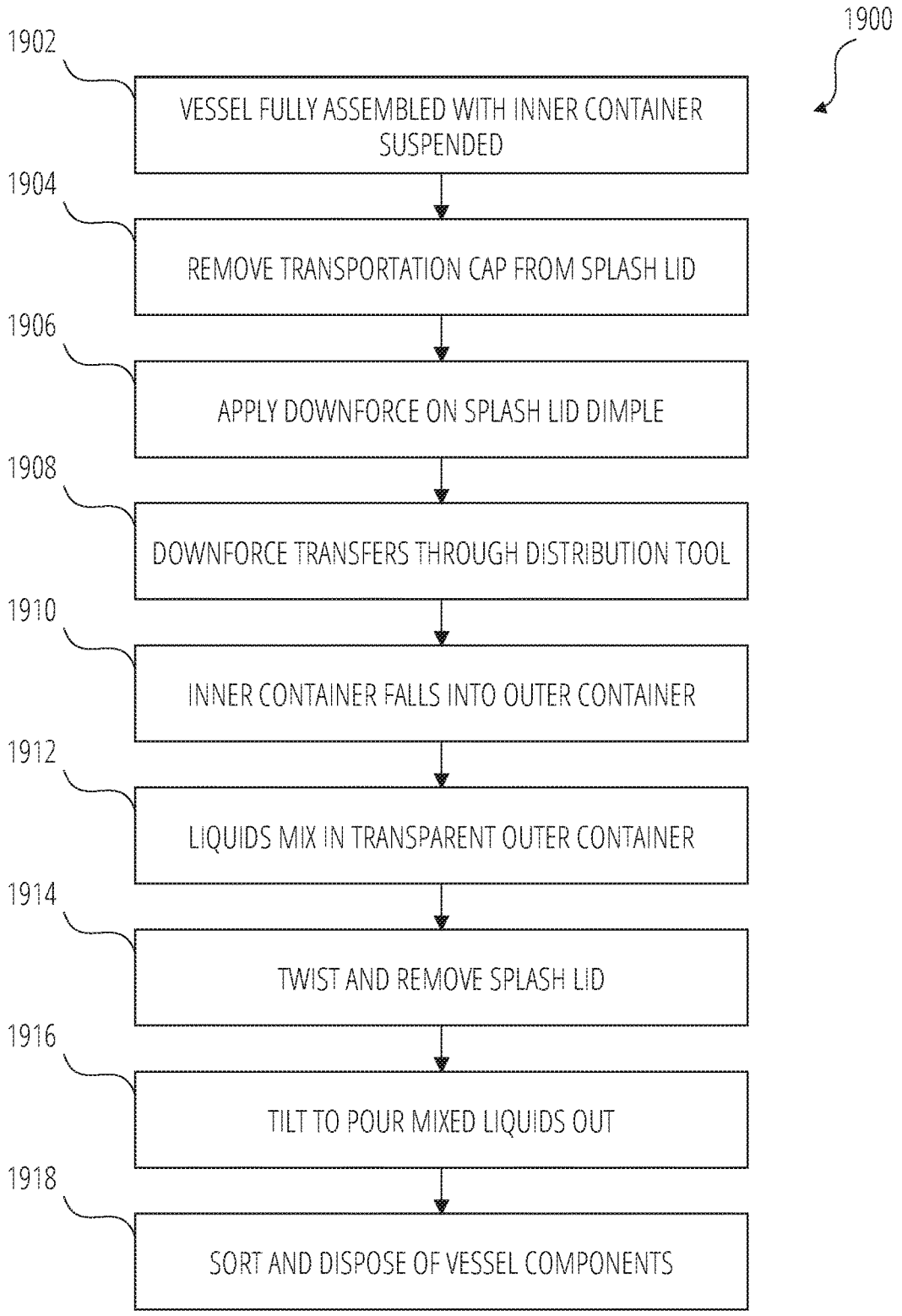
FIG. 19 is a flow chart illustrating an example method for assembling, using, and disposing of the dynamically mixing beverage vessel according to some examples.

FIG. 19 is a flow chart with reference numerals illustrating an example method 1900 for assembling, using, and disposing of the dynamically mixing beverage vessel according to some examples.

'In block 1902, the dynamically mixing beverage vessel 102 is first fully assembled with the inner shot container 110 secured in a suspended position within the splash lid 106. The splash lid 106 forms a liquid-tight seal with the outer mixing container 112 via mating threaded surfaces. Additionally, the transportation cap 104 is secured over the top of the splash lid 106, protecting the inner components during transportation and preventing accidental deployment of the inner shot container 110.

In block 1904, when a consumer wishes to deploy the inner shot container 110 and dynamically mix the isolated liquids, the first operation consists of removing the transportation cap 104 from the splash lid 106. This is accomplished by the user applying an upward force to the cantilevered tab 704 on one of the curved armatures 702 of the cap 104. This upward force elastically deforms the curved armatures 702, compromising the snap-fit seal between the cap 104 and splash lid 106. With the snap-fit seal compromised, the cap 104 can be fully removed from the splash lid 106.

In block 1906, with the transportation cap 104 removed, the consumer applies a downward force 302 to the center region of the splash lid 106, specifically in the area of the dimple 1406. When downforce is applied to the dimple 1406, this initiates the deployment of the inner shot container 110.

In block 1908, this downward force is then transferred through the force distribution member 108 to the inner ridge surface 306 of the inner shot container 110. When adequate force is applied by the user, the snap-fit seal formed between the outer rim 310 of the inner shot container 110 and the ridge groove 312 of the splash lid 106 is compromised.

In block 1910, with the snap-fit seal compromised, the inner shot container 110 is propelled downwards by into the outer mixing container 112. As the inner shot container 110 falls and impacts the liquid contents of the outer mixing container 112, a satisfying splash effect is generated.

In block 1912, the consumer can visually observe the isolated liquid contents of the inner shot container 110 and outer mixing container 112 dynamically mixing together through the transparent walls of the outer mixing container 112. The inner shot container 110 comes to rest on the bottom of the outer mixing container 112.

In block 1914, before consuming the dynamically mixed beverage, the consumer twists and removes the splash lid 106 from the outer mixing container 112.

In block 1916, with the lid 106 removed, the consumer tilts the outer mixing container 112 towards their mouth, allowing the liquids of the inner shot container 110 and outer mixing container 112 to flow out simultaneously. This provides the consumer with a properly mixed beverage experience.

Finally in block 1918, once the beverage is fully consumed, the vessel components can be easily sorted and disposed of in the appropriate manner.

Figure 20:
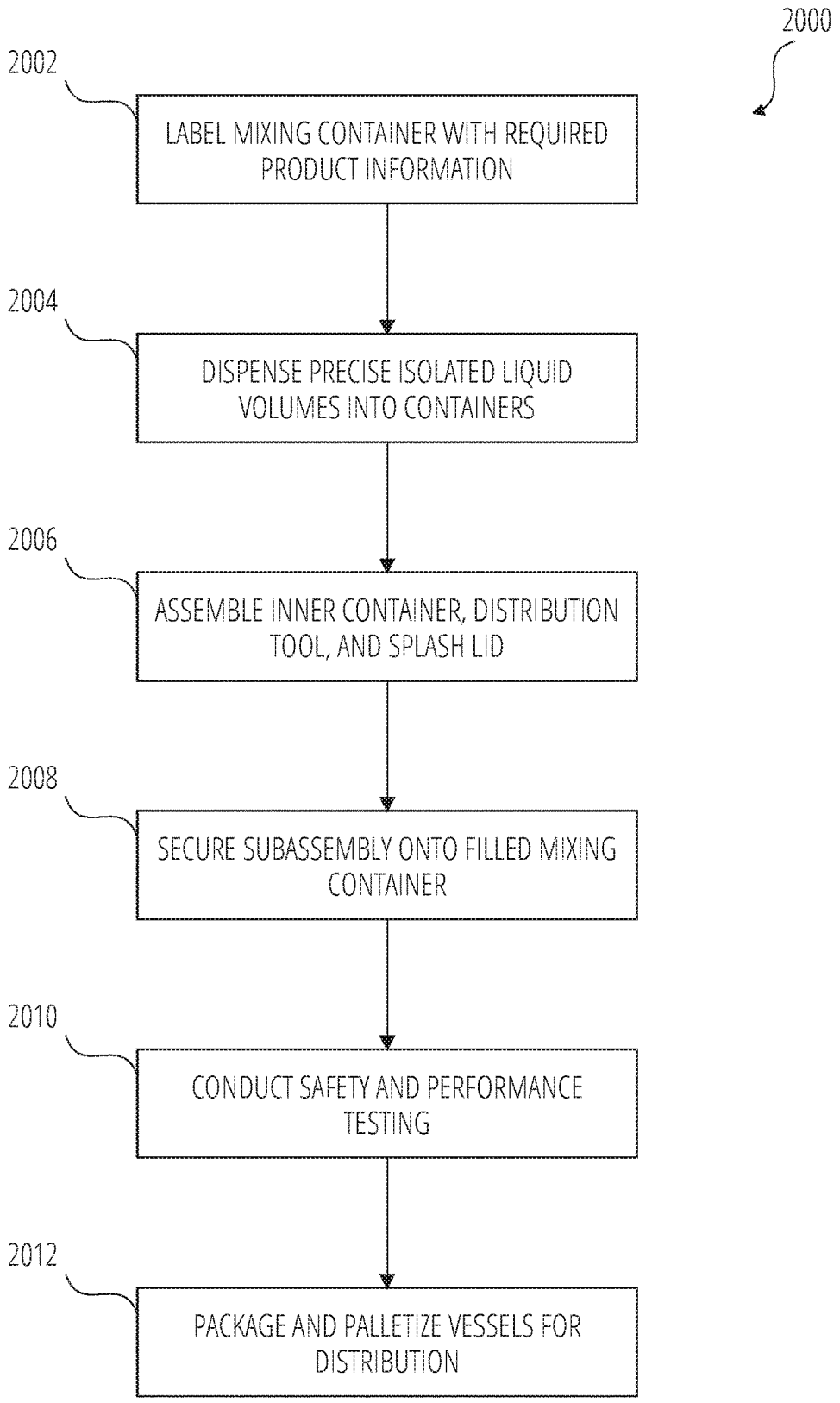
FIG. 20 is a flowchart illustrating a method of assembling a beverage vessel, according to some examples.

FIG. 20 is a flowchart illustrating a method 2000 of assembling a beverage vessel 102, according to some examples.

In block 2002, the outer mixing container 112 is properly labeled with information such as the product name, manufacturer, volume, ingredients, nutritional information, safe handling instructions, and any other required details. This provides the consumer with full transparency about the product they are purchasing. The outer mixing container 112 is also labeled with decorative artwork and branding elements as specified in final assembly work instructions. Vibrant graphics help attract consumer attention on crowded store shelves. The labeling operation may be completed by automated labeling machines or manual label applications, depending on production volumes. All labeling is applied to comply with FDA guidelines.

In block 2004, precise volumes of the appropriate liquid contents are dispensed into the outer mixing container 112 and inner shot container 110 before the subassembly process begins. For the inner shot container 110, the smaller volume of shot liquid is dispensed to the precise serving size. Automated liquid dispensing machines located along the beverage production line can rapidly fill thousands of containers per hour at high accuracy. Other filling methods include manual pouring or pneumatic dispensing valves. Filling is completed in a clean environment to prevent contamination. Precise, isolated filling ensures the consumer receives the full intended volumes of both liquids.

In block 2006, with the isolated liquids dispensed, the first subassembly operation begins. First, the rigid plastic force distribution member 108 is picked up by an automated tool or operator hand and centered precisely on the inner ridge surface 306 at the top of the inner shot container 110. Next, the threaded splash lid 106 is aligned concentrically above the inner shot container 110 subassembly. An automated or manual vertical pressing operation engages the snap-fit seal between the outer rim 310 of the inner shot container 110 and the mating ridge groove 312 on the underside of the splash lid 106. This creates a liquid-tight seal, isolating the shot liquid from the mixer liquid.

In block 2008, the subassembly of the inner shot container 110, force distribution member 108, and splash lid 106 is mated to the filled outer mixing container 112. The threaded neck on the outer mixing container 112 engages the interior thread 1602 on the interior surface of the splash lid 106. An automated or manual twisting motion rotates the subassembly onto the outer mixing container 112, securing the splash lid 106 tightly against the top sealing surface of the outer mixing container 112. This forms a second robust liquid seal, preventing leakage or contamination of the isolated liquid contents. Finally, the protective transportation cap 104 is pressed down over the top rim 1404 of the splash lid 106 until the curved snap-fit armatures 702 engage.

In block 2010, rigorous testing is conducted throughout the manufacturing process to ensure the assembled beverage vessels 102 meet safety and performance requirements. All components are made from FDA food-safe materials. Cleanliness is closely monitored. Critical seals are pressure tested. Final assemblies may undergo simulated vibration testing to verify the liquid seals withstand the rigors of transportation and distribution without premature deployment of the inner shot container 110. Detailed testing data provides quality assurance and identifies any defects before products reach consumers.

In block 2010, beverage vessels 102 that pass testing are packaged as specified, whether as single-unit containers or multi-packs of 4, 6, 8, 12, etc. Protective secondary packaging prevents damage during shipping and provides tamper evidence. Multiple beverage vessels 102 are assembled onto pallets for efficient handling and shipping. Strict quality control ensures consumers receive safe, properly functioning products that provide the full intended user experience.

Figure 21:
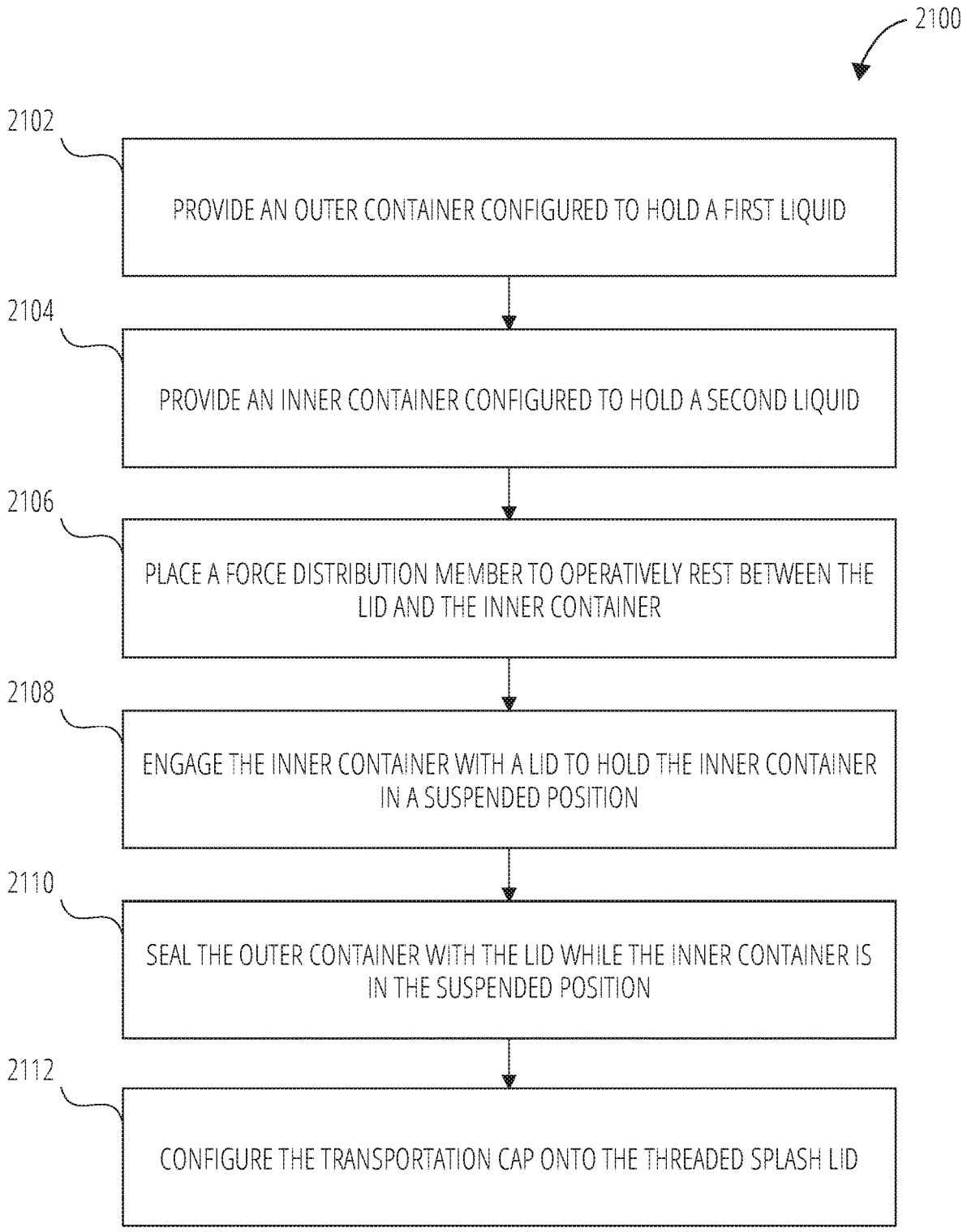
FIG. 21 is a flowchart illustrating a method, according to some examples, of manufacturing a beverage vessel.

FIG. 21 is a flowchart illustrating a method 2100, according to some examples, of manufacturing a beverage vessel 102.

In block 2102, method 2100 provides outer mixing container 112 configured to hold a first liquid. Outer mixing container 112 may be made of transparent, liquid-tight, non-porous materials such as plastic or glass as depicted in FIG. 17 to allow for visual observation of the mixing process. Outer mixing container 112 comprises a hollow inner volume sized to hold a larger quantity of a first liquid beverage. In some alternatives, outer mixing container 112 may include a threaded neck 1802 as shown in FIG. 18 to engage with corresponding threads 1602 on lid 106.

In block 2104, method 2100 provides inner container 110 configured to hold a second liquid, such as a shot-sized volume of liquid. Inner container 110 is sized smaller than outer mixing container 112 to fit within outer mixing container 112, as shown in FIG. 1. Inner container 110 may comprise a conical base 902, as depicted in FIG. 9, to promote mixing when released into outer mixing container 112.

In block 2106, method 2100 places force distribution member 108 to operatively rest between lid 106 and inner container 110. Force distribution member 108 rests on top of inner ridge surface 306 of inner container 110 and beneath contact slab 1306 of force distribution member 108, as shown in FIGS. 12-13.[ga1]

In block 2108, method 2100 engages inner container 110 with lid 106 to hold the inner container 110 in a suspended position within outer mixing container 112. This may be accomplished by snapping outer rim 310 of inner container 110 into ridge groove 312 of lid 106 to form a snap-fit seal as described in FIG. 16. The snap-fit seal suspends inner container 110 from lid 106.

In block 2110, method 2100 seals outer mixing container 112 with lid 106 while inner container 110 is in the suspended position. Lid 106 may comprise threads 1602 as in FIG. 16 that engage with threads 1802 of the outer mixing container 112 as in FIG. 18 to seal outer mixing container 112.

In block 2112, method 2100 configures transportation cap 104 on top of the lid 106 via the curved snap-fit curved armatures 702 completing an assembly of a single dynamically mixing beverage vessel 102. Once the cap 104 is secured to the assembly, the assembled vessel 102 is ready for transport and distribution. When the consumer is ready to deploy the inner shot container 110 from the lid 106, they simply remove the cap 104 and apply a downward force 302 to the downforce dimple 1406 on the lid 106. The downward force is transferred through force distribution member 108 to disengage snap-fit seal between the inner shot container 110 and lid 106, releasing inner container 110 into the outer mixing container 112.

Figure 22:
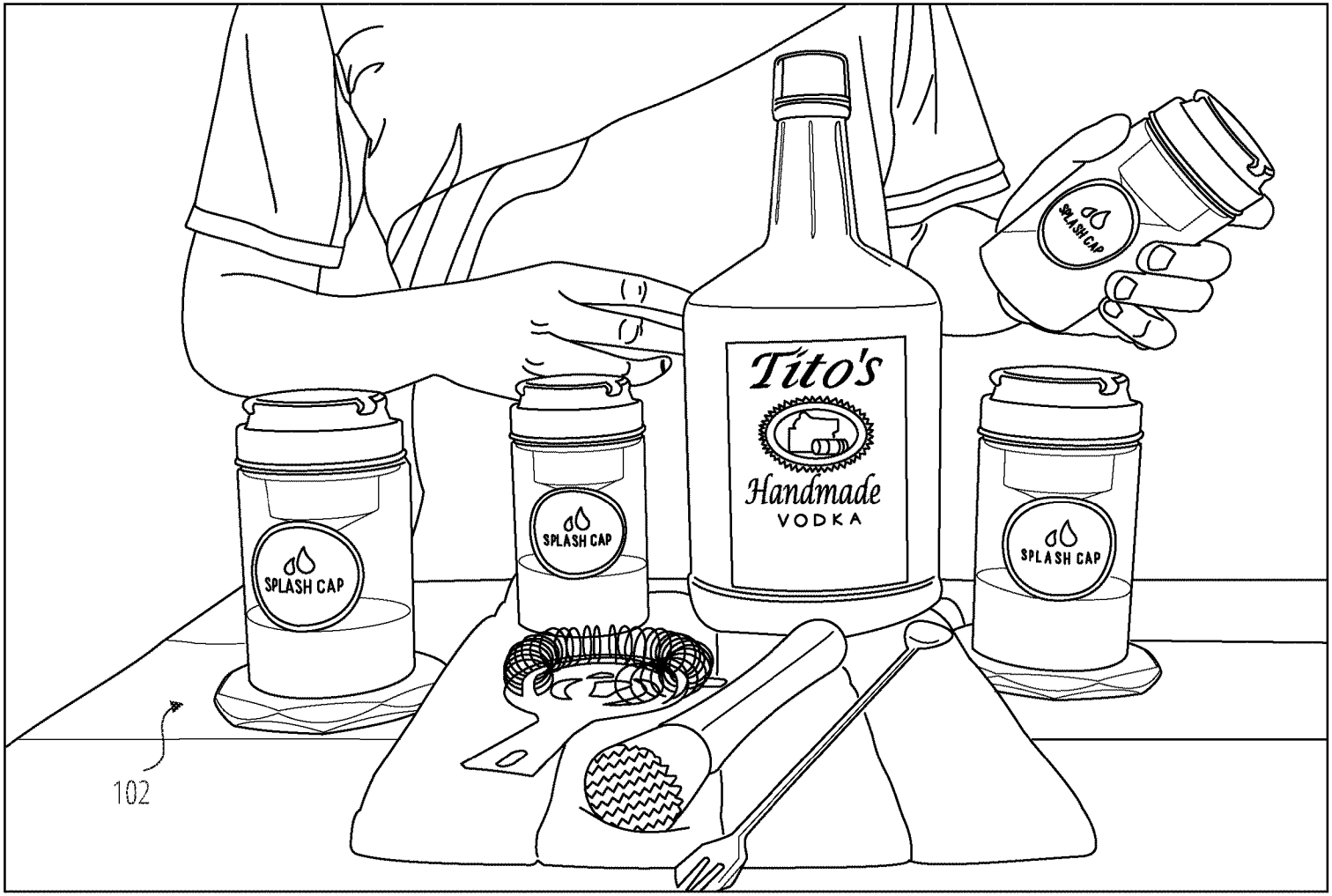
FIG. 22 is a photograph showing various assembled examples of a beverage vessel, as may be filled with fluids and served at an event.

FIG. 22 is a photograph showing various assembled examples of a beverage vessel 102, as may be filled with fluids and served at an event.

Various examples of methods of manufacture for the components of the beverage vessel 102, according to some examples, may include:

Transportation Cap 104:

The transportation cap 104 may be manufactured from a lightweight, plastic material similar to Polycarbonate or Polyethylene Terephthalate (PET). This material has some level of elasticity. When the consumer applies an upward force to the cantilevered tab 704 on one of the curved armatures 702 of the cap 104, the transportation cap 104 elastically deforms, compromising the snap-fit on the threaded splash lid 106. Once the external force applied to the transportation cap 104 is relieved, it reverts to its original shape without any noticeable plastic deformation. Furthermore, this plastic material may be rigid to protect outside debris from deploying the inner shot container 110 during transport. Furthermore, this plastic material may be rigid to protect outside debris from deploying the inner container 110 during transport.

The transportation cap 104 may be plastic injection molded. This method of manufacture is relatively inexpensive and conducive to high-volume production. The components may be molded in a single cavity or multi-cavity tool depending on desired production volumes. This method of manufacture is capable of producing large volumes of the transportation cap 104 out of the relatively inexpensive plastic material outlined above.

Mixing Container or Vessel 112:

The outer mixing container 112 may be manufactured from a transparent, lightweight glass or plastic material that allows the consumer to visually see the mechanical contraption in action. This material may be non-porous, food-safe, and liquid-tight. Some specific comparable materials are polyethylene terephthalate (PET), polycarbonate (PC), and high-density polyethylene (HDPE) plastics. Existing plastic water bottle manufacturers are utilizing all of these existing materials. Furthermore, the glass or plastic may be durable enough to withstand the harsh commercial beverage distribution environment. This material may also be recyclable.

The outer mixing container 112 may be injection-blow molded. This method of manufacture is commonly used for a variety of vessels in the portable beverage industry (e.g., plastic Coca-Cola, Sprite, Gatorade vessels, and glass mason jars). This method of manufacture is relatively inexpensive and conducive to high-volume production. The components may be molded with all of the threaded features on the outer mixing container 112 to minimize the amount of post-processing work required for production. The outer mixing container 112 will also be pressure tested after molding for any leaks or imperfections.

Inner Container 110:

The inner container 110 may be manufactured from a lightweight plastic (PET or Polycarbonate) or durable aluminum material. With either material, the inner container 110 may be non-porous, food safe, and liquid tight. Furthermore, the plastic or aluminum material may be recyclable.

If made from lightweight plastic, this component may be manufactured through the plastic injection molding process. This method of manufacture is relatively inexpensive and conducive to high-volume production. The components may be molded in a single cavity or multi-cavity tool depending on desired production volumes. This method of manufacture is capable of producing large volumes of the inner container 110 out of the relatively inexpensive plastic material outlined above. The tooling for the inner container 110 may be drafted so that the parts are easily ejected from the mold before the manufacturing cycle is repeated.

If made from aluminum or stainless steel, this component may be manufactured through a metal stamping process. This method of manufacture is relatively inexpensive and conducive to high-volume production. During this method, the raw edge from the metallic coils may be rolled to ensure there are no hazardous or rough edges on the lip of the inner container 110. The rolled aspect of the inner shot container is intended to protect the end consumer from any hazardous sharp edges from the product.

Splash Lid 106:

The splash lid 106 may be made from an elastic plastic material similar to high-density polyethylene (HDPE) or polypropylene (PP). This material may be non-porous, food-safe, and liquid-tight. This material may be elastic enough that the consumer can easily manipulate the dimple 1406, releasing the inner container 110. At the same time, this material must be strong enough to maintain its structural integrity when fastened to the neck of the mixing vessel 112. There may be static force applied to the splash lid 106 through the mating threads 1802 on the outer mixing container 112.

There may also be a thin rubber material inserted (manually or automatically in a multi-shot mold) on the sealing surfaces between the mixing vessel 112 and the splash lid 106. There may also be another rubber insert required between the inner container 110 and the ridge groove 312 of the lid 106. These rubber inserts would use complementary ridge and groove configurations in the molded plastic components to ensure that the contents stored in the inner container 110 do not contaminate the contents stored within the mixing vessel 112 and vice versa. The rubber inserts may be used as necessary.

The interior thread 1602 within the splash lid 106 may be designed into the injection molding tooling. This tooling will then include the necessary cams, gears, gibs, and guide pins to efficiently produce the threaded splash lids 106 in volume.

The splash lid 106 may be plastic injection molded. This method of manufacture is relatively inexpensive and conducive to high-volume production. The components may be molded in a single cavity or multi-cavity tool depending on desired production volumes. This method of manufacture is capable of producing large volumes of the splash lid 106 out of the relatively inexpensive plastic material outlined above.

Force Distribution Member 108:

The force distribution member 108 may be manufactured from a lightweight, plastic material similar to Polyethylene Terephthalate (PET). This material may be rigid and structurally sound so that it is capable of withstanding the downforce applied by the average consumer.

The force distribution member 108 will also be plastic injection molded. This method of manufacture is relatively inexpensive and conducive to high-volume production. The components may be molded in a single cavity or multi-cavity tool depending on desired production volumes. This method of manufacture is capable of producing large volumes of the force distribution member 108 out of the relatively inexpensive plastic material outlined above.

Example Advantageous Individual Component Features:

The transportation cap 104, as shown in FIG. 10-FIG. 11, is configured to protect inner container 110 and outer mixing container 112 from premature deployment during transportation. Cap 104 fits over lid 106 and seals deformable top surface 308. This prevents accidental force application and deployment of inner container 110. Cap 104 is made of rigid plastic to prevent force transfer to inner container 110.

The cap 104 features curved armatures 702 designed to securely snap over the rim 1404 of lid 106, ensuring a firm attachment as illustrated in FIG. 7. Among the armatures, one is equipped with a cantilevered tab 704, engineered specifically for user convenience. This cantilevered tab 704 allows for easy one-handed removal of cap 104 by applying an upward force 706, facilitating quick and effortless detachment. This design ensures that while the cap can be rapidly removed when needed, the vessel remains securely protected during transport, preventing accidental spills or contamination. The mechanism balances case of use with reliable security, making it practical for a variety of usage scenarios where both protection and accessibility are important."

Force distribution member 108, shown in FIG. 12-FIG. 13, is a downforce distribution tool between lid 106 and inner container 110. It includes an outer ring 1302 resting on inner ridge surface 306 of inner container 110. Contact slab 1306 contacts the deformable top surface 308 of the lid 106. Interior supports 1304 connect ring 1302 and contact slab 1306. This configuration efficiently transfers downward force 302 from the lid 106 to defined contact areas on inner container 110 to provide controlled release.

Lid 106 has multiple advantageous features as shown in FIG. 14-FIG. 16. Ridge groove 312 engages outer rim 310 of inner container 110 in a snap-fit to suspend inner container 110. Dimple 1406 indicates the area for users to apply downforce 302. Knurled edge 1402 allows easy grip and removal of lid 106. These features provide intuitive use and drinking access.

The inner container 110, as illustrated in FIG. 8 and FIG. 9, is equipped with a rolled outer rim 310 that securely engages with the ridge groove 312 located on the lid 106, thereby facilitating both suspension and sealing mechanisms. Additionally, the conical base 902 of the inner container is designed to enhance visual and auditory feedback upon its release into an outer mixing container 112, thus contributing to a dynamic and stimulating beverage consumption experience.

The outer mixing container 112, shown in FIG. 17 and FIG. 18, features a threaded neck that engages with threads 1602 on the lid 106, ensuring a secure and reliable seal. This design prevents leakage and maintains the integrity of the container's contents. The container is constructed from a transparent material, allowing users to view the mixing process in real-time. This visual transparency not only enables users to ensure proper mixing but also enhances the overall user experience by providing immediate feedback on the activity inside the container. Consequently, this design element contributes to a satisfying deployment experience by combining functionality with an engaging visual and sensory component.

Together these advantageous features and others described above provide controlled mixing of two isolated liquids for intuitive, mess-free, exciting on-the-go beverage enjoyment.

EXAMPLES

Example 1 is an apparatus comprising: an outer container to hold a first liquid; an inner container sized to fit within the outer container and to hold a second liquid, the inner container comprising an open end, an outer rim around the open end, and an inner ridge surface; a lid to hold the inner container in a suspended position within the outer container and seal the outer container, wherein the lid comprises a deformable top surface, and a ridge groove, the ridge groove being sized to accommodate the outer rim of the inner container to hold the inner container in the suspended position; and a force distribution member to operatively rest on the inner ridge surface of the inner container and below the deformable top surface of the lid, wherein the force distribution mem is to transfer a force applied to the deformable top surface of the lid to the inner container to release the inner container from the suspended position within the outer container by disengaging the outer rim from the ridge groove of the lid.

In Example 2, the subject matter of Example 1 includes, wherein the outer container is transparent.

In Example 3, the subject matter of Examples 1-2 includes, wherein the outer container comprises a threaded neck.

In Example 4, the subject matter of Examples 1-3 includes, wherein the inner container comprises a conical base.

In Example 5, the subject matter of Examples 1-4 includes, a cap shaped to fit over and seal the deformable top surface of the lid, the cap prevents accidental deployment of the inner container and application of force on the lid during transportation.

In Example 6, the subject matter of Examples 1-5 includes, wherein the lid further comprises: a threaded inner surface to form a threaded engagement with a threaded neck on the outer container; a rim, around the deformable top surface of the lid, configured to mate with a cap; a contact surface, on the deformable top surface of the lid, to provide a surface for contact with the cap; and a dimple on the deformable top surface comprising a circular angled feature to indicate to a user a location to apply a downforce to release the inner container; wherein the lid is made from a liquid-tight, non-porous plastic material, with thin-walled sections configured to be clastic and flexible and thick-walled sections configured to remain rigid; and wherein the lid and the inner container form a snap-fit seal by snapping the outer rim of the inner container into the ridge groove of the lid.

In Example 7, the subject matter of Examples 1-6 includes, wherein the force distribution member has a diameter smaller than an inner diameter of the inner container to operatively rest on the inner ridge surface of the inner container, the force distribution member comprising: an outer ring configured to rest on an inner ridge surface of the inner container; a plurality of interior supports connected to the outer ring; and a contact slab connected to the plurality of interior supports configured to contact with the lid, wherein the contact slab matches contours of the lid; and wherein the force distribution member is configured to distribute a downforce applied to the contact slab evenly to the outer ring resting on the inner ridge surface of the inner container.

In Example 8, the subject matter of Examples 5-7 includes, wherein the cap further comprising: one or more curved armatures extending from an interior surface of the cap to secure the cap to the lid; and one or more cantilevered tab on one of the curved armatures to facilitate removal of the cap; and wherein the cap is configured to mate with the lid to protect the inner container and outer container during transportation from pre-mature deployment.

Example 9 is a method comprising: providing an outer container configured to hold a first liquid; providing an inner container sized to fit within the outer container and configured to hold a second liquid, the inner container comprises an open end, an outer rim around the open end, and an inner ridge surface; providing a lid configured to seal the outer container, the lid comprises a ridge groove and a deformable top surface; providing a force distribution member configured to rest on the inner ridge surface of the inner container and below the lid; placing the force distribution member on the inner ridge surface of the inner container; snapping the outer rim of the inner container into the ridge groove of the lid to form a snap-fit seal between the lid and inner container, and the force distribution member rests between the lid and inner container; and threading the lid onto the outer container to seal the outer container.

In Example 10, the subject matter of Example 9 includes, wherein the outer container is transparent.

In Example 11, the subject matter of Examples 9-10 includes, wherein the outer container comprises a threaded neck.

In Example 12, the subject matter of Examples 9-11 includes, wherein the inner container comprises a conical base.

In Example 13, the subject matter of Examples 9-12 includes, wherein the force distribution member is configured to transfer a force applied on the to the inner container to release the inner container from a suspended position within the outer container.

In Example 14, the subject matter of Examples 9-13 includes, wherein the method further providing a cap configured to seal the deformable top surface of the lid.

In Example 15, the subject matter of Example 14 includes, wherein the cap is shaped to fit over the lid, the cap prevents accidental deployment of the inner container and application of force on the lid during transportation.

In Example 16, the subject matter of Examples 14-15 includes, wherein the cap comprises at least one curved armature with a cantilevered tab to facilitate removal from the lid.

In Example 17, the subject matter of Examples 9-16 includes, wherein the lid comprises a knurled outer edge to facilitate removal from the outer container.

In Example 18, the subject matter of Examples 9-17 includes, wherein the force distribution member comprises an outer ring, a contact slab, and a plurality of interior supports extending between the outer ring and the contact slab.

In Example 19, the subject matter of Examples 9-18 includes, wherein the outer container, the force distribution member, and the lid are made of food safe plastic.

In Example 20, the subject matter of Examples 9-19 includes, wherein the inner container is made of food safe plastic or aluminum.

In Example 21, the subject matter of Examples 14-20 includes, wherein the cap is made of plastic.

Example 22 is an apparatus comprising: an outer container configured to hold a first liquid; an inner container sized to fit within the outer container and configured to hold a second liquid; a lid configured to seal the outer container; and a force distribution member configured to transfer a force from the lid to the inner container.

In Example 23, the subject matter of Example 22 includes, wherein the outer container is transparent.

In Example 24, the subject matter of Examples 22-23 includes, wherein the inner container comprises a conical base.

In Example 25, the subject matter of Examples 22-24 includes, a cap configured to seal the lid.

In Example 26, the subject matter of Examples 22-25 includes, wherein the lid comprises a threaded inner surface configured to engage with the outer container.

In Example 27, the subject matter of Examples 22-26 includes, wherein the force distribution member comprises a contact slab configured to contact the lid and transfer force to the inner container.

In Example 28, the subject matter of Examples 22-27 includes, wherein the inner container, outer container, lid and force distribution member are configured to allow release of the inner container into the outer container when a force is applied to the lid.

In Example 29, the subject matter of Examples 22-28 includes, wherein the outer container and inner container are configured to keep liquids separate until the inner container is released into the outer container.

In Example 30, the subject matter of Examples 22-29 includes, wherein the lid comprises a removable cover to allow drinking access to the outer container.

In Example 31, the subject matter of Examples 22-30 includes, wherein the outer container comprises a threaded neck and the lid comprises mating threads to engage with the threaded neck.

In Example 32, the subject matter of Examples 22-31 includes, wherein the inner container comprises a rim configured to engage with the lid to hold the inner container in a suspended position.

In Example 33, the subject matter of Example 32 includes, wherein the rim of the inner container engages with the lid in a snap-fit.

In Example 34, the subject matter of Examples 22-33 includes, wherein the force distribution member is configured to disengage the inner container from the lid when a force is applied.

In Example 35, the subject matter of Examples 22-34 includes, a tab on the lid configured to allow a user to apply a force to release the inner container.

In Example 36, the subject matter of Examples 22-35 includes, a seal between the lid and outer container to prevent leakage.

In Example 37, the subject matter of Examples 22-36 includes, wherein the outer container and inner container comprise food-safe materials.

Example 38 is an apparatus comprising: an outer container configured to hold a first liquid; an inner container sized to fit within the outer container and configured to hold a second liquid, wherein the inner container is held in a suspended position within the outer container; a lid configured to hold the inner container in the suspended position; and a force distribution member configured to release the inner container from the suspended position when a force is applied to the lid.

In Example 39, the subject matter of Example 38 includes, wherein the outer container is transparent.

In Example 40, the subject matter of Examples 38-39 includes, wherein the inner container comprises a conical base.

In Example 41, the subject matter of Examples 38-40 includes, a cap configured to seal the lid.

In Example 42, the subject matter of Examples 38-41 includes, wherein the lid comprises a threaded inner surface configured to engage with a threaded neck of the outer container.

In Example 43, the subject matter of Examples 38-42 includes, wherein the force distribution member comprises a contact slab configured to contact the lid and transfer force to the inner container.

In Example 44, the subject matter of Examples 38-43 includes, wherein the inner container comprises a rim configured to engage with the lid to hold the inner container in the suspended position.

In Example 45, the subject matter of Example 44 includes, wherein the rim of the inner container engages with the lid in a snap-fit.

In Example 46, the subject matter of Examples 38-45 includes, sized and shaped for portability and handheld drinking after the inner container is released from the suspended position.

In Example 47, the subject matter of Example 46 includes, a tab on the lid configured to allow a user to apply a force to release the inner container.

In Example 48, the subject matter of Examples 46-47 includes, a seal between the lid and outer container to prevent leakage.

In Example 49, the subject matter of Examples 38-48 includes, wherein the outer container and inner container are configured to keep liquids separate until the inner container is released from the suspended position.

In Example 50, the subject matter of Examples 38-49 includes, wherein the force distribution member is configured to disengage the inner container from the lid when the force is applied.

In Example 51, the subject matter of Examples 38-50 includes, wherein the lid and inner container are configured for a snap-fit engagement to hold the inner container in the suspended position.

In Example 52, the subject matter of Examples 38-51 includes, wherein the inner container, outer container, lid and force distribution member are configured to allow release of the inner container into the outer container when the force is applied.

In Example 53, the subject matter of Examples 38-52 includes, wherein the outer container comprises a threaded neck and the lid comprises mating threads to engage with the threaded neck.

In Example 54, the subject matter of Examples 38-53 includes, wherein the force distribution member operatively rests between the lid and the inner container.

Example 55 is a method of manufacturing a beverage vessel, the method comprising: providing an outer container configured to hold a first liquid; providing an inner container configured to hold a second liquid; engaging the inner container with a lid to hold the inner container in a suspended position; placing a force distribution member to operatively rest between the lid and the inner container; sealing the outer container with the lid while the inner container is in the suspended position; and configuring the force distribution member to release the inner container from the suspended position within the outer container when a force is applied to the lid.

In Example 56, the subject matter of Example 55 includes, making the outer container transparent.

In Example 57, the subject matter of Examples 55-56 includes, shaping the inner container with a conical base.

In Example 58, the subject matter of Examples 55-57 includes, providing a cap to seal the lid.

In Example 59, the subject matter of Examples 55-58 includes, forming threads on an inner surface of the lid.

In Example 60, the subject matter of Examples 55-59 includes, shaping the force distribution member with a contact slab configured to contact the lid.

In Example 61, the subject matter of Examples 55-60 includes, shaping a rim on the inner container to engage with the lid.

In Example 62, the subject matter of Example 61 includes, configuring the rim for snap-fit engagement with the lid.

In Example 63, the subject matter of Examples 55-62 includes, configuring the lid to allow removable access for drinking.

In Example 64, the subject matter of Examples 55-63 includes, forming a tab on the lid for a user to apply force.

In Example 65, the subject matter of Examples 55-64 includes, sizing and shaping the vessel for one-handed drinking.

In Example 66, the subject matter of Examples 55-65 includes, sealing between the lid and outer container.

In Example 67, the subject matter of Examples 55-66 includes, isolating liquids in the outer and inner containers.

In Example 68, the subject matter of Examples 55-67 includes, using food-safe materials for the outer and inner containers.

In Example 69, the subject matter of Examples 55-68 includes, configuring the force distribution member to disengage the inner container from the lid.

In Example 70, the subject matter of Examples 55-69 includes, shaping the lid and inner container for snap-fit engagement.

In Example 71, the subject matter of Examples 55-70 includes, allowing release of the inner container into the outer container when force is applied.

In Example 72, the subject matter of Examples 55-71 includes, forming threads on the outer container to engage with the lid.

In Example 73, the subject matter of Examples 55-72 includes, placing the force distribution member between the lid and inner container.

Example 74 is at least one machine-readable medium including instructions that, when executed by processing circuitry, cause the processing circuitry to perform operations to implement of any of Examples 1-73.

Example 75 is an apparatus comprising means to implement of any of Examples 1-73.

Example 76 is a system to implement of any of Examples 1-73.

Example 77 is a method to implement of any of Examples 1-73.

What is claimed is:

1. An apparatus comprising:

an outer container to hold a first liquid;

an inner container sized to fit within the outer container and to hold a second liquid, the inner container comprising an open end, an outer rim around the open end, and an inner ridge surface;

a lid to hold the inner container in a suspended position within the outer container and seal the outer container, wherein the lid comprises a deformable top surface, and a ridge groove, the ridge groove being sized to accommodate the outer rim of the inner container to hold the inner container in the suspended position;

a force distribution member to operatively rest on the inner ridge surface of the inner container and below the deformable top surface of the lid, wherein the force distribution member is to transfer a force applied to the deformable top surface of the lid to the inner container to release the inner container from the suspended position within the outer container by disengaging the outer rim from the ridge groove of the lid; and a cap shaped to fit over and seal the deformable top surface of the lid, the cap prevents accidental deployment of the inner container and application of force on the lid during transportation.

2. The apparatus of claim 1, wherein the outer container is transparent.

3. The apparatus of claim 1, wherein the outer container comprises a threaded neck.

4. The apparatus of claim 1, wherein the inner container comprises a conical base.

5. The apparatus of claim 1, wherein the cap further comprising:

one or more curved armatures extending from an interior surface of the cap to secure the cap to the lid; and one or more cantilevered tabs on the one or more curved armatures to facilitate removal of the cap; and wherein the cap is configured to mate with the lid to protect the inner container and the outer container during transportation from pre-mature deployment.

6. An apparatus comprising:

an outer container to hold a first liquid;

an inner container sized to fit within the outer container and to hold a second liquid, the inner container comprising an open end, an outer rim around the open end, and an inner ridge surface;

a lid to hold the inner container in a suspended position within the outer container and seal the outer container, wherein the lid comprises a deformable top surface, and a ridge groove, the ridge groove being sized to accommodate the outer rim of the inner container to hold the inner container in the suspended position; and a force distribution member to operatively rest on the inner ridge surface of the inner container and below the deformable top surface of the lid, wherein the force distribution member is to transfer a force applied to the deformable top surface of the lid to the inner container to release the inner container from the suspended position within the outer container by disengaging the outer rim from the ridge groove of the lid, wherein the lid further comprises:

a threaded inner surface to form a threaded engagement with a threaded neck on the outer container;

a rim, around the deformable top surface of the lid, configured to mate with a cap;

a contact surface, on the deformable top surface of the lid, to provide a surface for contact with the cap; and a dimple on the deformable top surface comprising a circular angled feature to indicate to a user a location to apply a downforce to release the inner container;

wherein the lid is made from a liquid-tight, non-porous plastic material, with thin-walled sections configured to be elastic and flexible and thick-walled sections configured to remain rigid; and wherein the lid and the inner container form a snap-fit seal by snapping the outer rim of the inner container into the ridge groove of the lid.

7. An apparatus comprising:

an outer container to hold a first liquid;

an inner container sized to fit within the outer container and to hold a second liquid, the inner container comprising an open end, an outer rim around the open end, and an inner ridge surface;

a lid to hold the inner container in a suspended position within the outer container and seal the outer container, wherein the lid comprises a deformable top surface, and a ridge groove, the ridge groove being sized to accommodate the outer rim of the inner container to hold the inner container in the suspended position; and a force distribution member to operatively rest on the inner ridge surface of the inner container and below the deformable top surface of the lid, wherein the force distribution member is to transfer a force applied to the deformable top surface of the lid to the inner container to release the inner container from the suspended position within the outer container by disengaging the outer rim from the ridge groove of the lid, wherein the force distribution member has a diameter smaller than an inner diameter of the inner container to operatively rest on the inner ridge surface of the inner container, the force distribution member comprising:

an outer ring configured to rest on the inner ridge surface of the inner container;

a plurality of interior supports connected to the outer ring; and a contact slab connected to the plurality of interior supports configured to contact with the lid, wherein the contact slab matches contours of the lid; and wherein the force distribution member is configured to distribute a downforce applied to the contact slab evenly to the outer ring resting on the inner ridge surface of the inner container.

* * * * *